US009675862B2

(12) United States Patent
Solheim et al.

(10) Patent No.: US 9,675,862 B2
(45) Date of Patent: Jun. 13, 2017

(54) METHODS, APPARATUS, AND SYSTEMS TO CUSTOM FIT GOLF CLUBS

(75) Inventors: John K. Solheim, Anthem, AZ (US); Gregory J. Swartz, Anthem, AZ (US); Paul D. Wood, Phoenix, AZ (US); Marty R. Jertson, Cave Creek, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 1328 days.

(21) Appl. No.: 12/118,378

(22) Filed: May 9, 2008

(65) Prior Publication Data

US 2009/0088276 A1 Apr. 2, 2009

Related U.S. Application Data

(60) Provisional application No. 60/976,077, filed on Sep. 28, 2007.

(51) Int. Cl.

| | |
|---|---|
| ***A63B 57/00*** | (2015.01) |
| ***A63B 69/36*** | (2006.01) |
| ***A63B 24/00*** | (2006.01) |
| ***A63B 60/42*** | (2015.01) |
| *A63B 53/00* | (2015.01) |
| *A63B 71/06* | (2006.01) |

(52) U.S. Cl.

CPC ..... *A63B 69/36* (2013.01); *A63B 24/0003* (2013.01); *A63B 24/0021* (2013.01); *A63B 60/42* (2015.10); *A63B 69/3608* (2013.01); *A63B 69/3623* (2013.01); *A63B 69/3632* (2013.01); *A63B 69/3658* (2013.01); *A63B 2024/0031* (2013.01); *A63B 2024/0034* (2013.01); *A63B 2053/005* (2013.01); *A63B 2071/065* (2013.01); *A63B 2220/05* (2013.01); *A63B 2220/35* (2013.01); *A63B 2220/89* (2013.01); *A63B 2225/50* (2013.01)

(58) Field of Classification Search

CPC . A63B 69/36; A63B 69/3608; A63B 69/3632; A63B 69/3658; A63B 2069/3605; A63B 2243/0029; A63B 24/0021

USPC ..... 473/407, 409

See application file for complete search history.

(56) References Cited

U.S. PATENT DOCUMENTS

| | | | | |
|---|---|---|---|---|
| 4,059,270 | A | 11/1977 | Sayers | |
| 5,591,091 | A * | 1/1997 | Hackman | 473/289 |
| 5,846,139 | A | 12/1998 | Bair et al. | |
| 5,879,241 | A | 3/1999 | Cook et al. | |
| 5,911,636 | A | 6/1999 | Schmoll | |
| 5,951,410 | A | 9/1999 | Butler et al. | |

(Continued)

FOREIGN PATENT DOCUMENTS

| | | |
|---|---|---|
| JP | H09117534 | 5/1997 |
| JP | H09308710 | 12/1997 |

(Continued)

OTHER PUBLICATIONS

U.S. Appl. No. 12/051,501, Pending, Solheim et al.

(Continued)

*Primary Examiner* — William H McCulloch, Jr.
*Assistant Examiner* — Chase Leichliter

(57) ABSTRACT

Examples of methods, apparatus, and systems to custom fit golf clubs by providing gapping determination are generally described herein. Other examples may be described and claimed.

48 Claims, 11 Drawing Sheets

(56) References Cited

U.S. PATENT DOCUMENTS

| | | | | |
|---|---|---|---|---|
| 6,083,123 | A * | 7/2000 | Wood | 473/409 |
| 6,328,660 | B1 | 12/2001 | Bunn | |
| 6,379,258 | B1 | 4/2002 | To | |
| 6,431,990 | B1 | 8/2002 | Manwaring | |
| 6,565,449 | B2 | 5/2003 | Buhler | |
| 6,672,978 | B1 * | 1/2004 | Morgan et al. | 473/407 |
| 6,719,648 | B1 | 4/2004 | Smith | |
| 6,929,558 | B2 | 8/2005 | Manwaring et al. | |
| 6,966,843 | B2 | 11/2005 | Rankin et al. | |
| 7,041,014 | B2 * | 5/2006 | Wright et al. | 473/409 |
| 7,056,225 | B1 | 6/2006 | Pipkin | |
| 7,147,570 | B2 | 12/2006 | Toulon et al. | |
| 7,153,215 | B2 * | 12/2006 | Peterson et al. | 473/199 |
| 7,166,035 | B2 * | 1/2007 | Voges et al. | 473/222 |
| 7,273,427 | B2 * | 9/2007 | Inoue et al. | 473/407 |
| 7,967,695 | B2 | 6/2011 | Voges et al. | |
| 2002/0072429 | A1 * | 6/2002 | Rankin et al. | 473/287 |
| 2002/0098898 | A1 | 7/2002 | Manwaring | |
| 2002/0132681 | A1 * | 9/2002 | Sosin | 473/287 |
| 2002/0142855 | A1 * | 10/2002 | Cook et al. | 473/282 |
| 2002/0155896 | A1 | 10/2002 | Gobush et al. | |
| 2003/0008731 | A1 | 1/2003 | Anderson et al. | |
| 2003/0027655 | A1 | 2/2003 | Lutz et al. | |
| 2003/0040380 | A1 * | 2/2003 | Wright et al. | 473/409 |
| 2003/0054327 | A1 | 3/2003 | Evensen | |
| 2003/0119595 | A1 | 6/2003 | Manwaring et al. | |
| 2003/0191547 | A1 | 10/2003 | Morse | |
| 2004/0006442 | A1 * | 1/2004 | Boehm | 702/145 |
| 2004/0023725 | A1 | 2/2004 | Llewellyn et al. | |
| 2004/0127303 | A1 * | 7/2004 | Teraoka | 473/196 |
| 2004/0204257 | A1 | 10/2004 | Boscha et al. | |
| 2004/0259653 | A1 | 12/2004 | Gobush et al. | |
| 2005/0070366 | A1 | 3/2005 | Manwaring et al. | |
| 2005/0085309 | A1 * | 4/2005 | McGann et al. | 473/151 |
| 2005/0159231 | A1 | 7/2005 | Gobush | |
| 2005/0181884 | A1 | 8/2005 | Beach et al. | |
| 2005/0215336 | A1 | 9/2005 | Ueda et al. | |
| 2005/0215340 | A1 | 9/2005 | Stites et al. | |
| 2005/0268704 | A1 | 12/2005 | Bissonnette et al. | |
| 2005/0272512 | A1 | 12/2005 | Bissonnette et al. | |
| 2005/0272513 | A1 | 12/2005 | Bissonnette et al. | |
| 2005/0272516 | A1 | 12/2005 | Gobush | |
| 2005/0277483 | A1 | 12/2005 | Peterson et al. | |
| 2005/0282645 | A1 * | 12/2005 | Bissonnette et al. | 473/131 |
| 2006/0014588 | A1 | 1/2006 | Page | |
| 2006/0166757 | A1 | 7/2006 | Butler, Jr. et al. | |
| 2006/0211510 | A1 | 9/2006 | Ashida et al. | |
| 2007/0049393 | A1 | 3/2007 | Gobush | |
| 2007/0135225 | A1 | 6/2007 | Nieminen et al. | |
| 2007/0167247 | A1 | 7/2007 | Lindsay | |
| 2007/0167249 | A1 | 7/2007 | Voges et al. | |
| 2007/0265105 | A1 | 11/2007 | Barton et al. | |
| 2007/0298896 | A1 | 12/2007 | Nusbaum et al. | |
| 2008/0020867 | A1 | 1/2008 | Manwaring | |
| 2008/0026869 | A1 | 1/2008 | Galloway | |
| 2008/0039222 | A1 | 2/2008 | Kiraly | |
| 2008/0132361 | A1 | 6/2008 | Barber | |
| 2008/0182685 | A1 * | 7/2008 | Marty et al. | 473/407 |
| 2008/0188353 | A1 | 8/2008 | Vitolo et al. | |
| 2009/0005188 | A1 | 1/2009 | Iwatsubo et al. | |
| 2009/0017930 | A1 | 1/2009 | Burnett et al. | |
| 2009/0088275 | A1 | 4/2009 | Solheim et al. | |
| 2009/0088276 | A1 | 4/2009 | Solheim et al. | |
| 2009/0131189 | A1 | 5/2009 | Swartz et al. | |
| 2009/0131193 | A1 | 5/2009 | Swartz et al. | |
| 2009/0215549 | A1 | 8/2009 | Burnett et al. | |
| 2010/0151956 | A1 | 6/2010 | Swartz et al. | |
| 2011/0028247 | A1 | 2/2011 | Ligotti et al. | |
| 2011/0039632 | A1 | 2/2011 | Bennett et al. | |

FOREIGN PATENT DOCUMENTS

| | | | |
|---|---|---|---|
| JP | 2001145718 | | 5/2001 |
| JP | 2001511045 | | 8/2001 |
| JP | 2002119621 | | 4/2002 |
| JP | 2003042716 | | 2/2003 |
| JP | 2003199859 | | 7/2003 |
| JP | 2003102892 | | 8/2003 |
| JP | 2004135908 | | 5/2004 |
| JP | 2006031430 | | 2/2006 |
| JP | 2006247023 | | 9/2006 |
| WO | WO02081039 | | 10/2002 |
| WO | 2005053798 | A2 | 6/2005 |
| WO | 2007095081 | A1 | 8/2007 |
| WO | WO2007095081 | | 8/2007 |

OTHER PUBLICATIONS

Gregory J. Swartz, et al., "Methods, Apparatus, and Systems to Custom Fit Golf Clubs," U.S. Appl. No. 12/358,616, filed Jan. 23, 2009.

Gregory J. Swartz, et al., "Methods, Apparatus, and Systems to Custom Fit Golf Clubs," U.S. Appl. No. 12/358,463, filed Jan. 23, 2009.

Gregory J. Swartz, et al., "Methods, Apparatus, and Systems to Custom Fit Golf Clubs," U.S. Appl. No. 12/694,121, filed Jan. 26, 2010.

John K. Solheim, et al., "Methods, Apparatus, and Systems to Custom Fit Golf Clubs," U.S. Appl. No. 12/051,501, filed Mar. 19, 2008.

Gardiner Golf Simulator Systems, "Fusing Technology with the Art of Golf," May 23, 2006, http://web.archive.org/web/20060523042206/http://www.golf-simulators.com/physics.htm, pp. 1-13.

John K. Solheim, et al., "Methods, Apparatus, and Systems to Custom Fit Golf Clubs," U.S. Appl. No. 12/118,378, filed May 9, 2008, May 9, 2008.

* cited by examiner

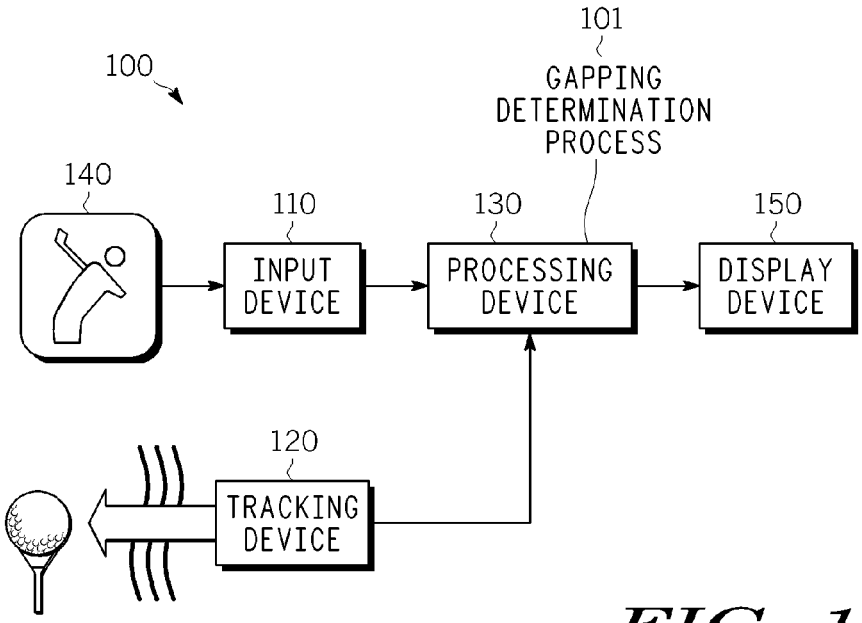
FIG. 1
FIG. 2
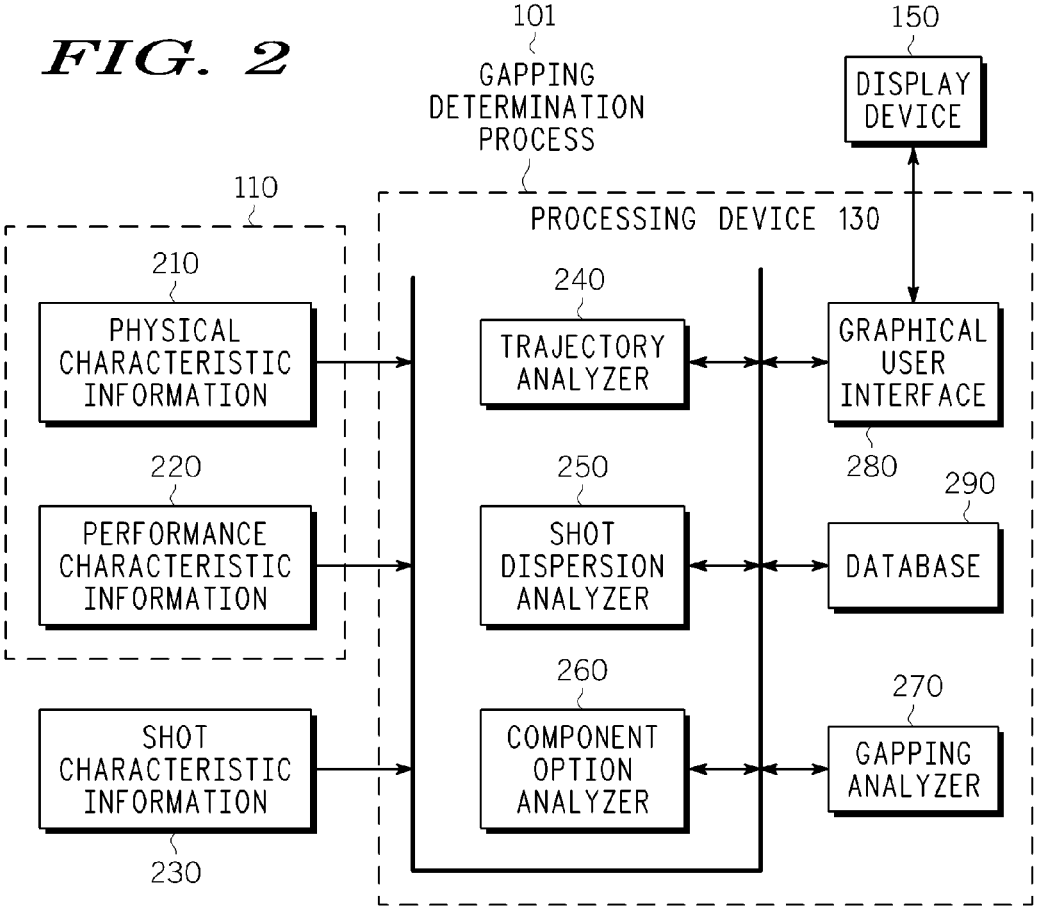

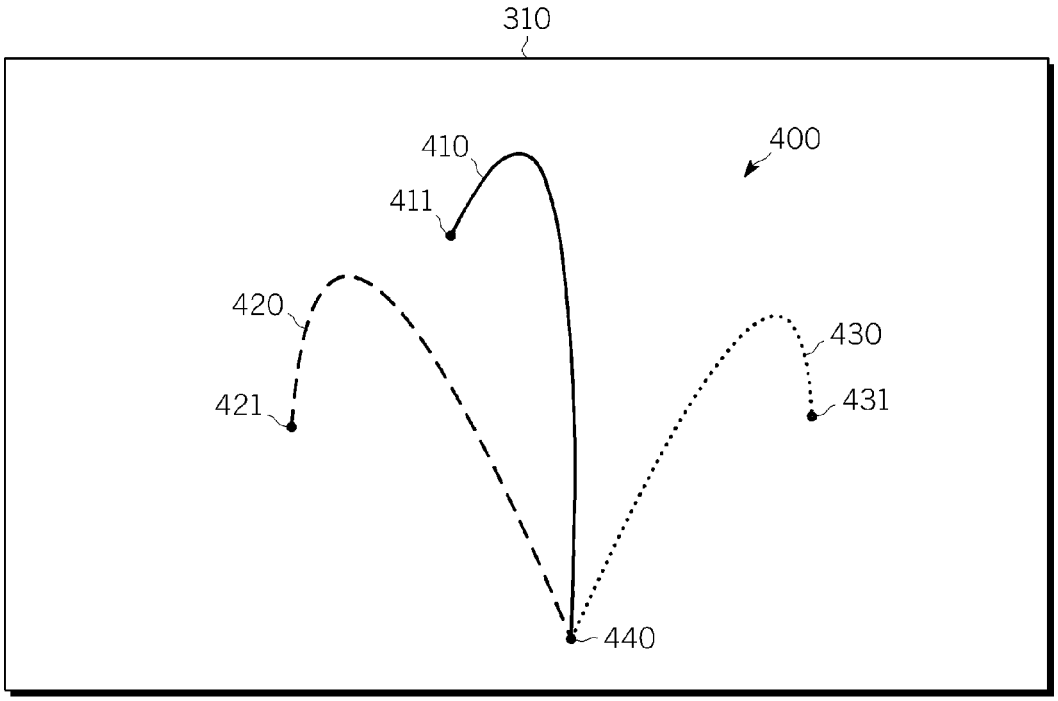
FIG. 4
FIG. 5
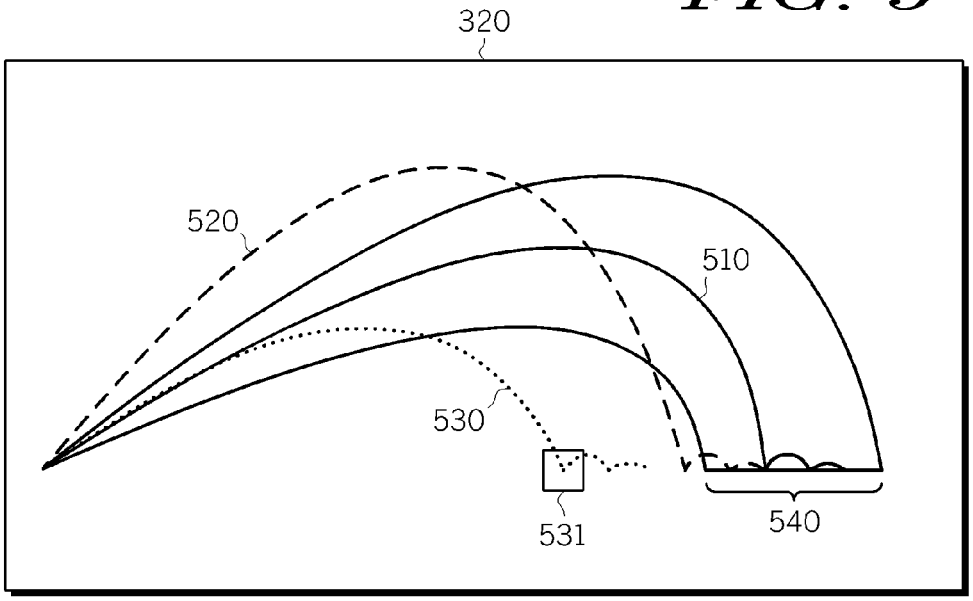

700

| TYPE | CLUB | MODEL | CARRY DISTANCE (706) | TOTAL DISTANCE (708) | GAP DISTANCE |
|---|---|---|---|---|---|
| MEASURED | LOB WEDGE | A | 81 (704) | 81 | – |
| CALCULATED | SAND WEDGE | A | 90 | 90 | 9 (702) |
| CALCULATED | PITCHING WEDGE | A | 110 | 111 | 20 |
| CALCULATED | 9-IRON | B | 120 | 122 | 10 |
| CALCULATED | 8-IRON | B | 130 | 135 | 10 |
| CALCULATED | 7-IRON | B | 140 | 147 | 10 (710) |
| MEASURED | 6-IRON | B | 150 | 159 | 10 (720) |
| CALCULATED | 5-IRON | B | 160 | 170 | 10 (730) |
| CALCULATED | 4-IRON | B | 165 | 180 | 5 (740) |
| CALCULATED | HYBRID 22° | C | 170 | 180 | 5 |
| CALCULATED | HYBRID 18° | C | 180 | 195 | 10 |
| MEASURED | HYBRID 15° | C | 185 | 205 | 5 |
| CALCULATED | 5-FAIRWAY WOOD | C | 190 | 205 | 5 |
| CALCULATED | 3-FAIRWAY WOOD | C | 210 | 230 | 20 |
| MEASURED | DRIVER | D | 240 | 260 | 30 |

(710, 720, 730 → 711)

340

*FIG. 7*

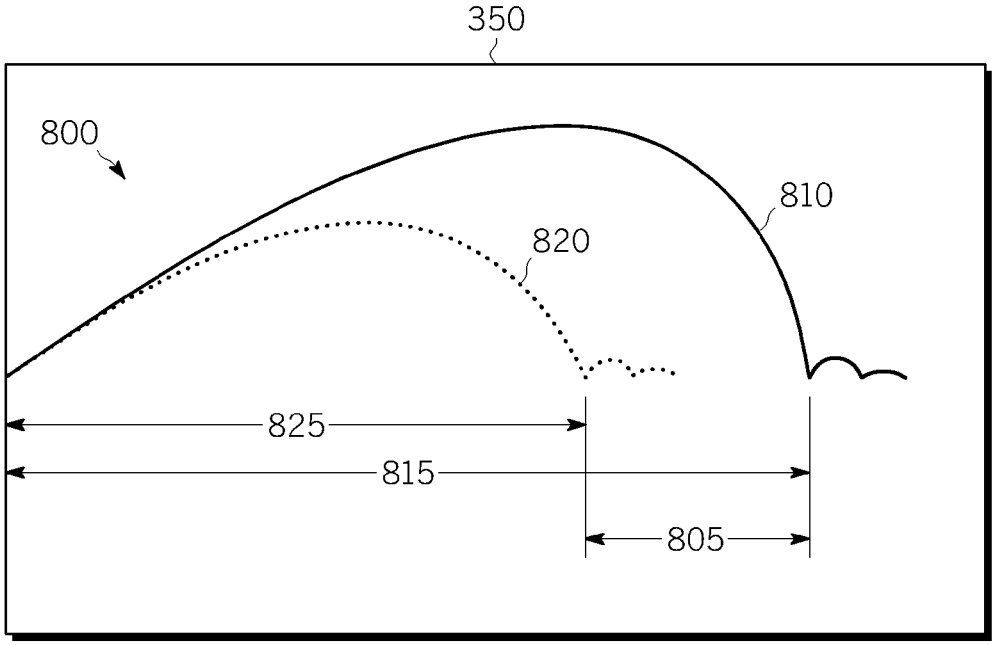
FIG. 8
FIG. 9
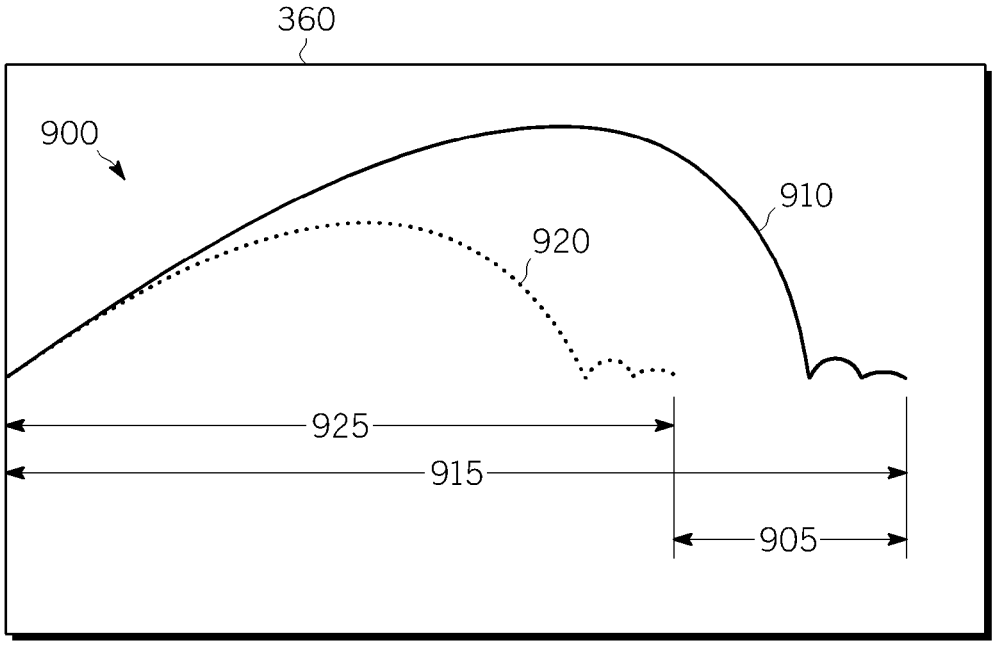

METHODS, APPARATUS, AND SYSTEMS TO CUSTOM FIT GOLF CLUBS

CROSS REFERENCE TO RELATED APPLICATIONS

This application claims the benefit of U.S. Provisional Patent Application Entitled: METHODS, APPARATUS, AND SYSTEMS TO CUSTOM FIT GOLF CLUBS, No. 60/976,077 filed Sep. 28, 2007, the contents of which are hereby incorporated by reference. This application is also related to co-pending U.S. patent application Ser. No. 12/051,501, filed Mar. 19, 2008, entitled "Methods, Apparatus, and Systems to Custom Fit Golf Clubs," by Solheim, et al., the contents of which are incorporated by reference herein.

TECHNICAL FIELD

The present disclosure relates generally to sport equipment, and more particularly, to methods, apparatus, and systems to custom fit golf clubs.

BACKGROUND

To ensure an individual is playing with appropriate equipment, the individual may be custom fitted for golf clubs. In one example, the individual may be fitted for golf clubs (e.g., iron-type golf clubs) according to the custom fitting process developed by PING®, Inc. to match the individual with a set of golf clubs. As part of the custom fitting process developed by PING®, Inc., for example, a color code system may be used to fit individuals of varying physical characteristics (e.g., height, wrist-to-floor distance, hand dimensions, etc.), swing tendencies (e.g., hook, slice, pull, push, etc.), and ball flight preferences (e.g., draw, fade, etc.) with iron-type golf clubs. With custom-fitted golf clubs, individuals may play golf to the best of their abilities.

BRIEF DESCRIPTION OF THE DRAWINGS

The present description will be better understood from the following detailed description read in light of the accompanying drawings, wherein:

FIG. 1 is a block diagram representation of an exemplary custom golf club fitting system that can provide gapping determination.

FIG. 2 depicts a block diagram showing further detail of the exemplary custom golf club fitting system that can provide gapping determination.

FIG. 4 depicts an example of the three dimensional shot trajectory display, the user interface or display.

FIG. 5 depicts an example of a two dimensional shot trajectory display of the user interface or display.

FIG. 7 depicts an example of a tabular representation of the component option display of the user interface or display.

FIG. 8 depicts an example of a display of gapping between exemplary clubs based on initial ground contact of a hit ball of the user interface or display.

FIG. 9 depicts an example of a display of gapping between exemplary clubs based on final position of a hit ball of the user interface or display.

Like reference numerals are used to designate like parts in the accompanying drawings.

DESCRIPTION

Figure 3:
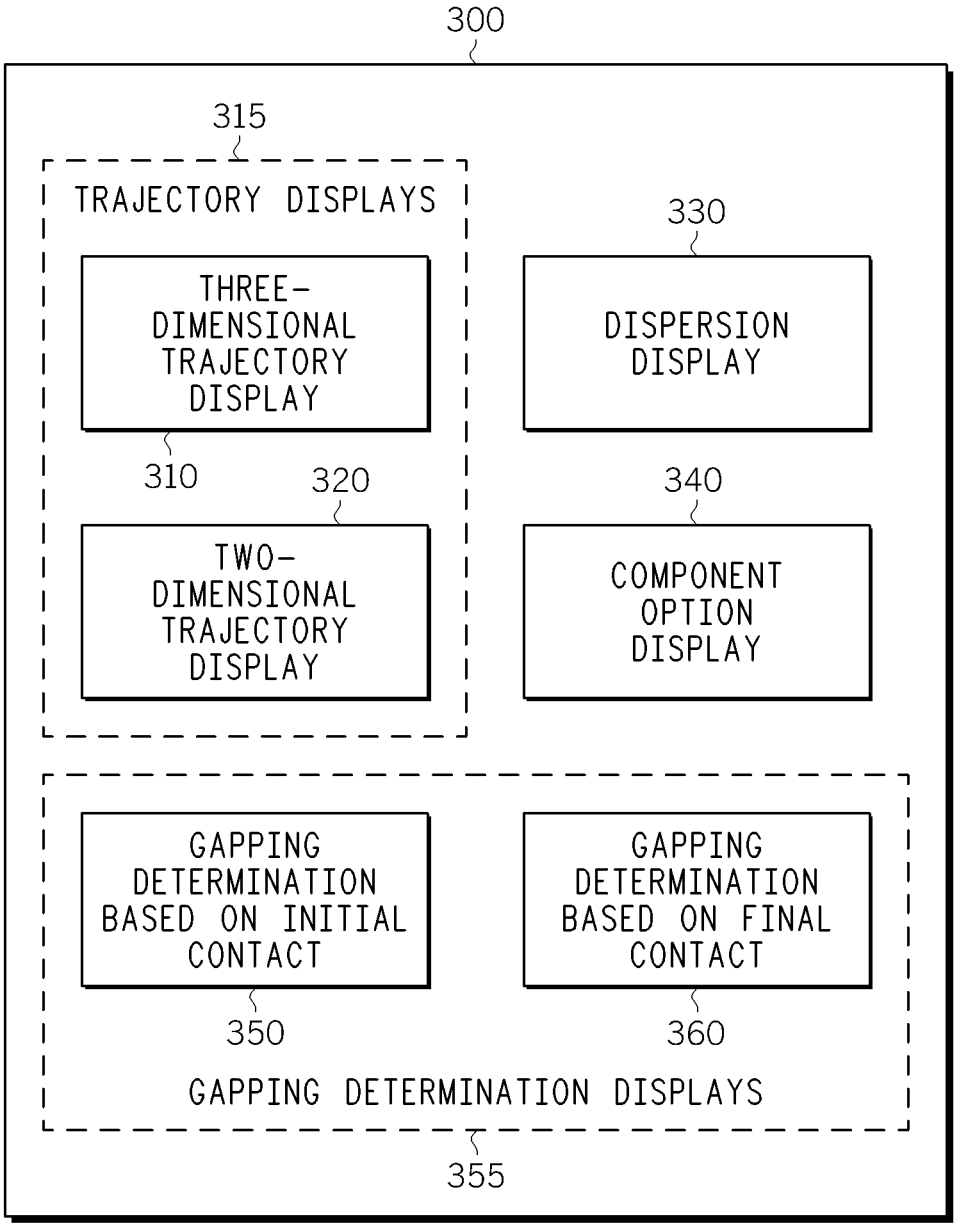
FIG. 3 depicts an example of gapping determination user interfaces, or displays, of the exemplary custom golf club fitting system that can provide gapping determination.

The detailed description provided below, in connection with the appended drawings, is intended as a description of the present examples, and is not intended to represent the only forms in which the present example may be constructed or utilized. The description sets forth the functions of the example and the sequence of steps for constructing and operating the example. However, the same or equivalent functions and sequences may be accomplished by different examples.

The examples below describe the fitting of golf clubs to a user, or player and in particular, providing a gapping analysis or determination. Gapping determination can be part of a club fitting system that provides other functions such as, determining the best length, grip, weight, loft, or the like, for a particular user, or player. Gapping analysis and fitting ("gapping") can refer to determining the distance a plurality of golf clubs may hit a golf ball, and adjusting the shot distances between the golf clubs to fall within a gap or range. In an example, the difference between shot distances of adjacent clubs (the "gap") of a plurality of clubs, may be maintained as a uniform distance. In alternative examples, gaps between clubs may be adjusted non-uniformly, or in any specified manner. Also, different gaps may be specified for different clubs as desired. For example, the gaps between woods may be chosen to differ from the gaps between the irons in the set. Gaps may be adjusted by club selection, and changing one or more club parameters in varying amounts to suggest a set of clubs having a designed gap and the like. Information used to determine or estimate the club gaps can include player swing information, library information or models for estimating ball flight and the like for various clubs and club options which can be applied to a process which models or otherwise estimates the specified gaps. In particular, information regarding the final stages of ball flight may be determined from initial measured ball flight information.

Although the present examples are described and illustrated herein as being implemented in a club fitting system, the system described is provided as an example and not a limitation. As those skilled in the art will appreciate, the present examples are suitable for application in a variety of different types of club fitting systems.

FIG. 1 is a block diagram representation of an exemplary custom golf club fitting system that can provide gapping determination 100. A fitting system 100 may include an input device 110 coupled to a tracking device 120 (e.g., a ball launch monitor and/or a ball flight monitor), and a processing device 130. The processing device 130 can also be coupled to a conventional display device 150. The input device 110 and the tracking device 120, may be coupled to the processing device 130 via a wireless connection and/or a wired connection. The input device 110 may be coupled to the processing device 130 by one or more wired and/or wireless connections. The fitting system can implement a gapping determination process 101.

The fitting system 100 may be used to fit various golf clubs such as driver-type golf clubs, fairway wood-type golf clubs, hybrid-type golf clubs, iron-type golf clubs, wedge-type golf clubs, putter-type golf clubs, and/or any other suitable type of golf clubs. Fitting may include analysis of various parameters to produce a suggested set of clubs. In particular, ball launch parameters for test shots made by the player 140 for two or more clubs, may be applied to all other possible clubs to produce ball flight information for a club. Comparison of ball flight for two or more clubs, shows the gaps in shot coverage for the player 140 being fitted with the clubs. In an example described below, the fitting system 100 may suggest a set of clubs having specified gaps.

The input device 110 may be conventionally constructed and can be chosen to assist in the interview portion of a custom fitting session with a player, or user 140. Typically, any number of interview questions can be completed. However, in most cases, if more questions are answered, the better the results. The input device 110 may be coupled to the processing device 130, so that preferences and other information associated with physical and performance characteristics of the individual 140 being fitted for one or more golf clubs, may be entered into the processing device 130 via the input device 110.

An exemplary input device 110 can be a keyboard and/or mouse working in conjunction with the display device 150. The input device 150 may also be a touch-sensitive display, a track pad, a track ball, wireless ordering terminal, paperless entry system, personal interview with an operator for later data entry, a voice recognition system, USB port (for accepting a memory stick, or other storage device), data port, internet connection (for remote entry of data), other suitable human interface device (HID), or the like. In general, any type of data collection and input device suitable for collecting input data may be utilized as an input device 110.

Exemplary data collected by the input device 110 may include one or more categories of data. Extensive use of player 140 test data may be used to account for differences between irons, hybrids, fairway woods, wedges and the like. Exemplary categories may include; a player's 140 physical characteristics, a player's 140 performance characteristics, a player's shot characteristics, or the like. However, other categories may be equivalently formed if desired. Model accuracy tends to be based more on the amount of data provided, rather than a particular organization of the data in categories.

The tracking device 120 can be conventionally constructed and may measure characteristics associated with a shot of a golf ball with a particular golf club made by a player 140. For example, an exemplary photographic tracking device 120 may take a plurality of data points, while an exemplary radar tracking device 120 may provide more detailed information. In particular, shot characteristic information such as that previously described, may be collected with a tracking device 120. To provide the processing device 130 with shot characteristic information, the tracking device 120 may be coupled to the processing device 130 via one or more wired and/or wireless connection(s).

The processing device 130 may be conventionally constructed and may include a processor, microprocessor, graphics processor, and associated circuitry for carrying out a process for determining appropriate gapping of a set of clubs 101, utilizing information from the input device 110, and the tracking device 120. The processor 130 can generate one or more user interfaces for displaying, on the display device 150, the results determined by the process 101, which can include gapping information, trajectory display's shot dispersion displays, component dispersion displays and the like. Also, the processing device may control the acquisition of data from the input device 110 and the tracking device 120 by controlling the flow of data from those devices, and also by providing a data input display 150 to guide the entry of data during the data input or interviewing phase.

FIG. 2 depicts a block diagram showing further detail of the exemplary custom golf club fitting system 100 that can provide gapping determination. The processing device 130 may include a trajectory analyzer block 240, a shot dispersion analyzer block 250, a component option analyzer block 260, a gapping analyzer block 270, a graphical user interface block 280 and a database block 290. The devices can be in communication with each other, by conventional methods, to carry out an exemplary gapping determination process 101, and generation of the appropriate user interfaces 280.

Each block 240, 250, 260, 270, 280, 290, may exist as a series of coded instructions, or as a memory location according to conventional programming structures. An object oriented programming language such as C# or the like, may be utilized to code the instructions. Alternatively, one or more of the blocks may be combined, or further divided into sub-blocks to implement the gapping determination process 101.

As described in detail below, the processing device (130 of FIG. 1) in conjunction with a gapping determination process 101, utilizing one or more blocks 240, 250, 260, 270, may provide recommendations to custom fit an individual (140 of FIG. 1) with one or more golf clubs based on the exemplary inputs of physical characteristic information 210, and performance characteristic information 220 from the input device (110 of FIG. 1). The tracking device (120 of FIG. 1) may provide shot characteristic information 230 to the processing device (130 of FIG. 1). The functional processing blocks 240, 250, 260, 270, 280, 290, player inputs data 210, 220, 230, and information from the database 290 may be processed by one or more blocks to provide a gapping determination 101 for creation of a display by the graphical user interface block 280 in recommending clubs having appropriate gaps.

Exemplary physical characteristic information 210 may include gender (e.g., male or female), age, dominant hand (e.g., left-handed or right-handed), hand dimension(s), (e.g., hand size, longest finger, etc. of dominant hand), height (e.g., head to toe), wrist-to-floor distance, and/or other suitable characteristics.

Exemplary player performance characteristic information, or player preferences 220, may include the types and number of clubs desired in a set (number of irons, wedges, woods and the like), the length of the clubs. Also, gap information can be specified, for example, a desired constant gap between all clubs, a non-uniform gap, specifying specific gaps between specific clubs, or any other way of indicating a gap or gaps, may be specified. Average carry distance of one or more golf clubs, (e.g., average carry distance of a shot by the individual with a driver golf club, a 7-iron golf club, etc.), golf handicap, number of rounds played per a period of time (e.g., month, quarter, year, etc.), golf preferences (e.g., distance, direction, trajectory, loft, shot pattern, etc.), and/or other suitable characteristics may also be provided. Player preferences can be collected during an interview process, by typically responding to questions, or the like.

Shot characteristic information, or alternatively launch conditions 230, may include information collected from swinging one or more clubs. In particular, take off information collected when the ball is hit, and for several feet afterwards, may be used to determine gap information at the end of the ball's flight. In an example, information can be collected from two clubs. In an alternative example, information may be taken from three clubs, typically one in the middle of the set, and the other two as far away as possible from each other and the middle club.

Shot characteristic information 230 collected can include, ball speed, vertical launch angle, back spin. Ball speed of a golf ball can be its speed in response to impact with the golf club. Launch angle of the golf ball can be the angle of the ball's trajectory in response to impact with the golf club. Thus, the exemplary shot characteristic information includes information allowing three dimensional modeling. However, if two dimensional parameters are utilized in alternative embodiments, the gapping determination can still be made, but usually with reduced precision as reflected in the gapping results.

Other measured shot characteristics 230 may include, horizontal launch angle, side spin, club speed, smash factor (based on a ball speed/club speed relationship), carry distance, total distance, offline distance and/or other suitable characteristics. The methods, apparatus, and systems described herein are not limited in this regard. Exemplary shot characteristics 230 may include information collected from a tracking device (120 of FIG. 1), or alternatively, shot information estimated from other inputs, such as a cataloged player test data.

The trajectory analyzer 240 may analyze the shot characteristic information 230 and the like, to generate information for a two-dimensional trajectory display, a three-dimensional trajectory display or the like that can be processed for display 150 by the graphical user interface 280. These displays 150 may be generated using initial launch data 230 to determine final or end characteristics of the shot. Thus, initial conditions can model where the ball lands, which leads to determining gaps between clubs.

The shot dispersion analyzer 250 may analyze the shot characteristic information 230 to a generate shot dispersion information for processing and display by the graphical user interface 280. A shot dispersion display can show how consistently a player can place a shot. All data points generated by the shot dispersion analyzer 250, may be utilized for determining a gap or outlying shots can be identified and eliminated.

The component option analyzer 260 may analyze the physical characteristic information 210, the performance characteristic information 220, and/or the shot characteristic information 230 to identify a suitable option for one or more components of a golf club, and in particular, gapping determination. Typically, a set of clubs or list of clubs, may be determined, which can be provided to the graphical user interface 280 for display 150 as a table, chart, graph or the like.

The component option analyzer 260, may identify a particular model based on swing speed of a golf club and gender of the individual (140 of FIG. 1), (e.g., model options). Based on the selected model option, the component option analyzer 260 may identify one or more lofts offered by the manufacturer with the selected model option (e.g., loft options). The component option analyzer 260 may also provide one or more types of shafts (e.g., regular, stiff, extra stiff, and soft), associated with the selected model option and the selected loft option (e.g., shaft options). For example, the component option analyzer 260 may identify shaft options based on swing speed of the individual. Based on the selected model option, the selected loft option, and the selected shaft option, the component option analyzer 260 may identify one or more lengths associated with the selected model option, the selected loft option, and the selected shaft option. Further, the component option analyzer 260 may identify one or more grips associated with the selected model option, the selected loft option, the selected shaft option, and the selected length option. For example, the component option analyzer 260 may identify a relatively thinner grip so that the individual may generate a less tilted axis of rotation of the golf ball (e.g. less side spin), if the individual is hitting the golf ball with a slice trajectory but would like to have a straight trajectory. The methods, apparatus, and systems described herein are not limited in this regard.

The gapping analyzer 270 may analyze the physical characteristic information 210, the performance characteristic information 220, and/or the shot characteristic information 230 to identify a set of golf clubs with substantially uniform gap distances between two neighboring golf clubs in the set. In addition, this module may utilize the results of other blocks, 240, 250, 260 to produce gapping results that may be processed by the graphical user interface 280 for display 150.

The data base 290 can be conventionally constructed. The data base may act as a repository for stored club and shot information. Alternatively, club and shot information may be stored as a data structure on a computer readable media, or the like for loading into the data base. The data base 290 may interact with one or more blocks 240, 250, 260, 270, 280, as a temporary information repository, or to supply data for use in the gapping determination process 101 by one or more blocks 240, 250, 260, 270, 280. For example, the physical parameters of a number of different types of clubs, and their various options may be stored as cataloged or library data in the data base 290. In addition, launch conditions associated with the cataloged clubs may also be stored in the data base 290. Also, a number of simulated or actual ball flights may be stored for each cataloged club. The stored ball flight information, when used, may be averaged, selected to fit to the exemplary ball flight information, or similarly evaluated. The launch data may be taken from the interview session with the user (140 of FIG. 1), and/or may be collected from other users. In one example, the database 290 may be integrated within a central server (not shown) and the processing device 130 may download information from the database 290 to a local storage device or memory (not shown).

Although one or more components may be described as being separate blocks, in alternative examples, two or more components 240, 250, 260, 270, 280 of the processing device 130 may be integrated into a single block. While particular components may be described as being integrated within the processing device 130, in further alternative examples, one or more components may be separate from the processing device 130 for remote processing. The methods, apparatus, and systems described herein are not limited in this regard.

FIG. 3 depicts an example of gapping determination user interfaces, or displays 300, of the exemplary custom golf club fitting system (100 of FIG. 1) that can communicate gapping determinations. The displays can be produced by the graphical user interface block (280 of FIG. 2) and displayed on the previously described display device (150 of FIG. 1). Such graphical user interfaces 300 may include a plurality of displays shown as 310, 320, 330, 340, 350, 360.

For example, the plurality of displays 300 may include a three-dimensional trajectory display 310, a two-dimensional trajectory display 320 (where displays 310 and 320 may collectively be referred to as examples of trajectory displays 315), and a shot dispersion display 330, a component option display 340, or the like, for gapping determination. In addition, a display of gapping determination based on initial contact on landing 350, and a display of gapping determination based on final contact or roll 360 may be provided (where displays 350 and 360 may be considered examples of gapping determination displays 355). In alternative examples of the user interface 300, any number of displays may be provided. The information presented may be graphical, text, tabular or any format suitable for conveying gapping determination information.

In addition to, or in place of, the component option display 340, for example, the processing device (130 of FIG. 1) may provide a multi-media display (not shown) for informative or educational purposes. For example, the multi-media display may provide a video describing various aspect of a golf club, the game of golf, etc. Thus, the processing device may provide an informational or educational analysis instead of or in addition to providing recommendations for one or more golf clubs.

In general, the plurality of displays 300 may provide virtual depictions and/or information associated with a custom fitting session for golf clubs for gapping determination (101 of FIG. 1). Although a particular number of displays are shown in the figure, the plurality of displays 300 may include more or less displays that can provide virtual depictions and/or information associated with a custom fitting session for golf clubs. The examples described herein are not limited in this regard.

FIG. 4 depicts an example of the three dimensional shot trajectory display (310 of FIG. 3) displayed by the user interface or display. The three-dimensional trajectory display 310 may generate a plurality of trajectories 400, individually shown as traces 410, 420, and 430, which can be associated with a particular golf club. The traces start from an initial position representing the initial location 440 of a golf ball. The traces terminate where the ball would typically land or come to rest 421, 411, 431.

That is, the three-dimensional trajectory display 310 may generate a set of trajectories and information 400 from the perspective of the individual (140 of FIG. 1), striking the golf ball and/or from the perspective of someone located proximate to the individual (140 of FIG. 1). In one example, the three-dimensional trajectory display 310 may generate a first trajectory 410 indicative of a first shot of a golf ball using a particular golf club, a second trajectory 420 indicative of a second shot of a golf ball using the same golf club, and the third trajectory 430 indicative of a third shot of a golf ball using the same golf club. Information indicating the club being used, distance and other metrics may also be displayed. For example, distance of the shot, height of the shot, roll distance and the like, may also be displayed with or in place of the graphic. In addition, in alternative examples, a cursor (not shown) may be positioned over a trace 410, 420, 430 and information can be displayed for example, ball speed, height direction or the like.

Trajectories 410, 420, 430 may be keyed or differentiated in a number of ways. Although, the first trajectory 410, the second trajectory 420, and the third trajectory 430, can be depicted as a solid line, a broken line and a dashed line, respectively, the trajectories 400 may be depicted by colors, line widths, symbols, keys, labels and the like. In one example, the first trajectory 410 may be indicated by a first color (e.g., red), the second trajectory 420 may be indicated by a second color (e.g., blue), and the third trajectory 430 may be indicated by a third color (e.g., yellow).

As shown, three traces 410, 420, 430 representing shots with the same club are shown. The displays may be indicative of variance in a users (140 of FIG. 1) shooting ability, or the traces may indicate use of a club having different options. In another example, the first trajectory 410 associated with a first golf club, the second trajectory 420 associated with a second golf club, and the third trajectory 430 may be associated with a third club. The clubs may be the different types (3 iron, 5 iron, 1 wood or the like). The first, second, and third golf clubs may be different from each other in one or more component options as described in detail below (e.g., model, loft, lie, shaft, length, grip, etc.).

Trajectories 410, 420, 430 may represent one shot, or an average of any number of shots. Various conventional averaging methods may be applied if averaging is used. In particular, the first trajectory 410 may be indicative of an average of a number of shots associated with the first golf club. The second trajectory 420 may be indicative of an average of a number of shots associated with the second golf club. The third trajectory 430 may be indicative of an average of a number of shots associated with the third golf club. Accordingly, these trajectories may be differentiated as previously described.

In addition to trajectory information as described above, the three-dimensional trajectory display 310 may also provide environment information such as, for example, altitude, wind speed, humidity, and/or temperature of the location of the custom fitting session. While the examples above may depict and describe three trajectories 410, 420, and 430, the methods, apparatus, and systems described herein may include more, or less, trajectories in the display 310. The methods, apparatus, and systems described herein are not limited in this regard.

FIG. 5 depicts a first example of a two dimensional shot trajectory display that may be determined by the trajectory analyzer (320 of FIG. 3) of the user interface or display (300 of FIG. 3). In this example, the terminal reference point for a shot can be taken, as where the ball first touches the ground when it lands 531. The two-dimensional trajectory display 320 may generate one or more trajectories shown generally at 500, and shown as traces 510, 520, 530, relative to an optimal trajectory, or range of trajectories, 540. The two-dimensional trajectory display 320 shown, provides a side or lateral view of ball flights.

In particular, each of the trajectories 500 may be indicative of different shots with a particular golf club. For example, the first trajectory 510 may be indicative of a trajectory of a first shot with a golf club. The second trajectory 520 may be indicative of a second shot with the same golf club. The third trajectory 530 may be indicative of a third shot with the same golf club.

Alternatively, each of the trajectories 500 may be indicative of an average of a number of shots associated with a golf club. For example, the first trajectory 510 may be indicative of an average of a number of shots associated with a first golf club. The second trajectory 520 may be indicative of an average of a number of shots associated with a second golf club (e.g., different from the first golf club). The third trajectory 530 may be indicative of an average of a number of shots associated with a third golf club (e.g., different from the first and second golf clubs), where conventional averaging methods may be utilized In alternative examples, the first, second, and third golf clubs may be the same type of club but different from each other in one or more component options as described in detail below (e.g., model, loft, lie, shaft, length, grip, etc.).

The optimal trajectory range 540 may be indicative of a target range for an individual with particular swing parameters (e.g., swing speed, etc.). Trajectory ranges 540 may be indicated with a single trace, a shaded area between traces, an optimal trace with an indicator of permissible deviations, or the like. Accordingly, the trajectories 500 may be compared to the optimal trajectory range 540.

In addition to the trajectory information described above, the two-dimensional trajectory display 320 may also provide data, or text, indicating shot information, club speed, ball speed, smash factor, launch angle, back spin, side spin, vertical landing angle, offline distance, carry distance, associated with each shot and the like.

Further, the two-dimensional trajectory display 320 may expand or hide the shot information associated with a set of shots as desired. The methods, apparatus, and systems described herein are not limited in this regard.

Figure 6:
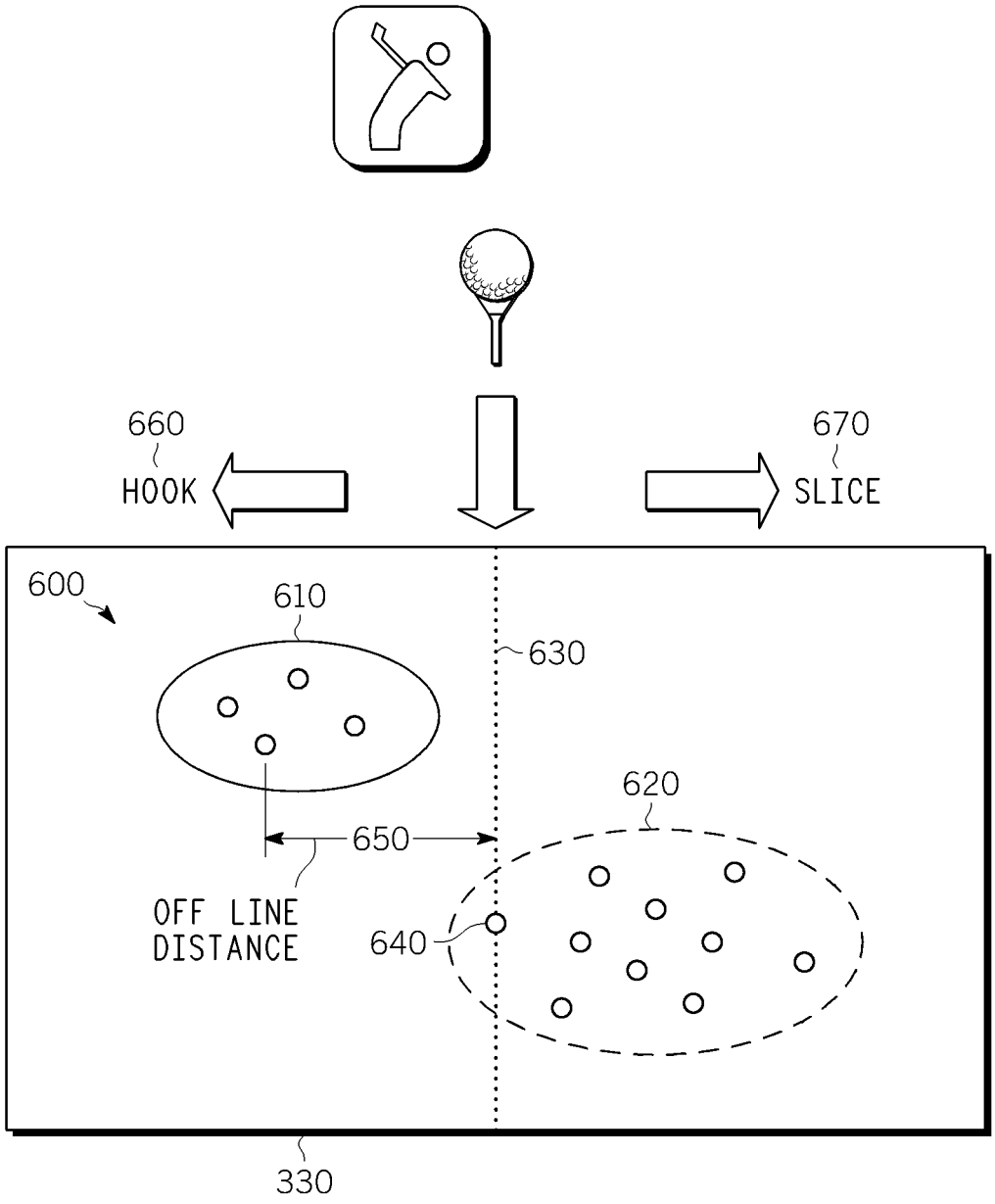
FIG. 6 depicts an example of a shot dispersion display of the user interface or display.

FIG. 6 depicts an example of a shot dispersion display (330 of FIG. 3) of the user interface or display that may be produced by the shot dispersion analyzer (240 of FIG. 2). The shot dispersion display 330 may generate one or more perimeters 600 associated with shot dispersions, generally shown as 610 and 620. Each of the perimeters 600 may enclose points of final shot contact of two or more shots taken with a particular golf club. Further, each perimeter may encompass a particular percentage of shots within an area (e.g., 90%), whereas a number of shots may fall outside of that particular perimeter (e.g., 10%).

Alternatively, the dispersion display 330 may generate a first perimeter 610 to inscribe a number of shots associated with a first golf club, and a second perimeter 620 to inscribe a number of shots associated with a second golf club (e.g., different from the first golf club). In particular, the first and second golf clubs may be different from each other in one or more component options (e.g., model, loft, lie, shaft, length, grip, etc.). The first perimeter 610 may be indicated by a first color (e.g., blue) whereas the second perimeter 620 may be indicated by a second color (e.g., red). Alternately, differing line types (dashed, solid) or the like, may be used to distinguish the perimeters.

The shot dispersion display may provide a center line 630 to depict a substantially straight shot (e.g., one showing a landing at a particular location 640). The center line 630 may also be used to determine an offline distance or deviation 650 from a straight shot of each shot taken. A shot to the left of the center line 630 may be a hook shot, or a draw shot 660 whereas a shot to the right of the center line 630 may be a slice shot, or a fade shot 670. For example, shots inscribed by the first perimeter 610 may include hook shots and draw shots. Shots inscribed by the second perimeter 620 may include draw shots, slice shots, or fade shots.

Although the perimeters 610, 620 may be shown as having elliptical shapes, perimeters with other suitable shapes (e.g., circular, rectangular, irregular etc.) may also be used. The methods, apparatus, and systems described herein are not limited in this regard.

FIG. 7 depicts an example of a tabular representation of the component option display (340 of FIG. 3) of the user interface or display (300 of FIG. 3). The component option display 340 may display one or more options associated with one or more components of a golf club. In one example, the component option display 340 may depict one or more models of driver-type golf clubs offered by a manufacturer based on the physical characteristic information (210 of FIG. 2), the performance characteristic information (220 of FIG. 2), and/or shot characteristic information (230 of FIG. 2) associated with the individual (140 of FIG. 1).

The gapping analyzer (270 of FIG. 2) may identify a plurality of possible golf clubs to complete a set having a substantially uniform gap distance. Alternatively, the gap may be non-uniform or selected according to any desired gapping criteria. A gap distance 702 may be the difference 704 between two carry distances of two neighboring clubs. Alternatively, the gap distance 702 could be specified as the difference between two total distances of two neighboring clubs, if specified in that manner. In particular, the gapping analyzer may identify golf clubs forming a set with a substantially uniform gap distance between two neighboring golf clubs of the set (e.g., excluding a driver-type golf club and a putter-type golf club). As shown in the figure, the Irons 711 have a 10 yard gap in their carry distances.

As shown in this exemplary table, the gap distance 710 between the 8-iron golf club and the 7-iron golf club for the individual, may be set to ten yards (e.g., the carry distances are 130 and 140 yards, respectively). Accordingly, the substantially uniform gap distance between two neighboring golf clubs of the set may also be about ten yards as well. As shown in the table, the gap distance 720 between the 7-iron golf club and the 6-iron golf club may be ten yards (e.g., the carry distances are 140 and 150 yards, respectively). Similarly, the gap distance 730 between the 6-iron golf club and the 5-iron golf club may also be ten yards (e.g., the carry distances are 150 and 160 yards, respectively).

In contrast to the substantially uniform 10 yard gap distances 710, 720, and 730, the gap distance 740 between the 5-iron golf club and the 4-iron golf club for the individual may be less than the substantially uniform gap distance of ten yards. Accordingly, the gapping analyzer may suggest or identify a hybrid-type golf club instead of a 4-iron golf club to keep the gap close to a uniform 10 yards since the gap distance 740 between the 5-iron golf club and the 4-iron golf club is less than the uniform gap distance of ten yards. The gapping analyzer may suggest a substitute to maintain a ten-yard gap distance between the 5-iron type golf club, and the next golf club within the set. Thus, the gapping analyzer may identify the hybrid 22° golf club because the gap distance between the 5-iron golf club and the hybrid 22° golf club may be ten yards (e.g., the carry distances for the 5-iron golf club and the hybrid 22° golf club are 160 and 170 yards, respectively).

In another alternative example, the gapping analyzer (220 of FIG. 2) may identify the hybrid 18° golf club instead of the hybrid 15° golf club because the gap distance between the hybrid 22° golf club and the hybrid 18° golf club may be ten yards (e.g., the carry distances are 170 and 180 yards, respectively) whereas, the gap distance between the hybrid 22° golf club and the hybrid 15° golf club may be fifteen yards (e.g., the carry distances are 170 and 185 yards, respectively).

By applying the shot characteristic information (230 of FIG. 2), (e.g., ball speed, ball launch angle, ball spin rate, etc.), in addition to swing speed of the individual (140 of FIG. 1), the gapping analyzer (220 of FIG. 2) may provide substantially uniform gap distances between two neighboring golf clubs within a set. Although the above example may describe the gap distance as the difference between two carry distances 706 of two neighboring clubs, the gap distance may be taken as the difference between two total distances (carry plus roll) 708 of two neighboring clubs.

In the example of FIGS. 8 and 9, the processing device (130 of FIG. 1) may generate one or more gapping analysis displays, previously shown as 350 and 360 of FIG. 3. Each of the gapping analysis displays 350 and 360 may provide visual representation of at least one gap distance, generally shown a gap between initial contact points as (805 of FIG. 8), and, a gap at end of the shot's roll (905 of FIG. 9), respectively, between two shots using different golf clubs (e.g., two golf clubs within a set).

FIG. 8 depicts a first example of a display of gapping between exemplary clubs based on initial ground contact of a hit ball of the user interface or display (350 of FIG. 3). The gap distance 805 may be a distance between the carry distances taken between two shots made with two different golf clubs. In one example, the individual (140 of FIG. 1) may strike a golf ball with a 6-iron golf club for 150 yards 810 whereas the individual (140 of FIG. 1) may strike a golf ball with a 5-iron golf club for 160 yards 820. Accordingly, the gap distance 805, between the 5-iron and 6-iron golf clubs may be ten yards. Further, the carry distances 815, 825 generally shown by the curves 810 and 820, may be a distance traveled by a golf ball from impact with a golf club the point where it first hits the ground to landing. As a result, the gap distance 805 may be a distance between the carry distance 815 associated with a first shot 810 and the carry distance 825 associated with a second shot 820. The methods, apparatus, and systems described herein are not limited in this regard.

FIG. 9 depicts an example of a display of gapping between exemplary clubs based on final position of a hit ball of the user interface or display (360 of FIG. 3). Here, the gap distance 905 may be a distance between total carry distances, plus roll or slip distances between shots taken with two different golf clubs. As a result, the gap distance 905 may be defined as a distance between the total distance 915 associated with a first shot and the total distance 925 associated with a second shot. The methods, apparatus, and systems described herein are not limited in this regard.

Golf ruling bodies may define the number of golf clubs available to the individual (140 of FIG. 1) during a round of golf (e.g., the number of golf clubs that the individual (140 of FIG. 1) may carry in a golf bag). For example, the individual (140 of FIG. 1) may be permitted to carry up to fourteen clubs in his/her bag. However, the individual (140 of FIG. 1) may not be able to use all fourteen clubs effectively. As described in detail below, selecting a set of clubs to maintain consistent gaps between shots for the spectrum of golf clubs in a set (e.g., fairway wood-type golf clubs, hybrid-type golf clubs, iron-type golf clubs, wedge-type golf clubs, etc.) may assist the performance of the individual (140 of FIG. 1), especially if their set of clubs may be limited.

Determining the gap can be done by considering various measured parameters, calculated parameters, and the like. In general, the gapping analyzer (270 of FIG. 2), either in cooperation with the other blocks 240, 250, 260, 290 or independently of, may analyze the physical characteristic information (210 of FIG. 2), the performance characteristic information (220 of FIG. 2), and/or the shot characteristic information (230 of FIG. 2) to provide a set of golf clubs with consistent gaps. The gapping analyzer (270 of FIG. 2) may use swing speed and additional shot characteristic information (230 of FIG. 2) such as, ball speed, ball launch angle, ball spin rate of two or more shots associated with two or more golf clubs to calculate, extrapolate, or otherwise determine ball launch parameters (e.g., ball speed, ball launch angle, ball spin rate, etc.) for other golf clubs that the individual (140 of FIG. 1) may use in a set.

In one example, the individual (140 of FIG. 1) may take two or more shots with a first golf club (e.g., 7-iron). The individual (140 of FIG. 1) may also take two or more shots with a second golf club (e.g., hybrid 22°). Based on the collected shot characteristic information (230 of FIG. 2) of these shots, and stored or cataloged reference data of golf clubs not used during the fitting sessions, the ball flight may be simulated. In providing a ball flight simulation, the gapping analyzer (270 of FIG. 2) may estimate ball launch parameters of various golf clubs for the individual (140 of FIG. 1). For example, the reference data may be calculated and/or measured from shots taken by other individuals for various clubs and options. The reference data may be stored in a database (290 of FIG. 2) for use in a modeling and/or similar estimating process. The methods, apparatus, and systems described herein are not limited in this regard.

Figure 10:
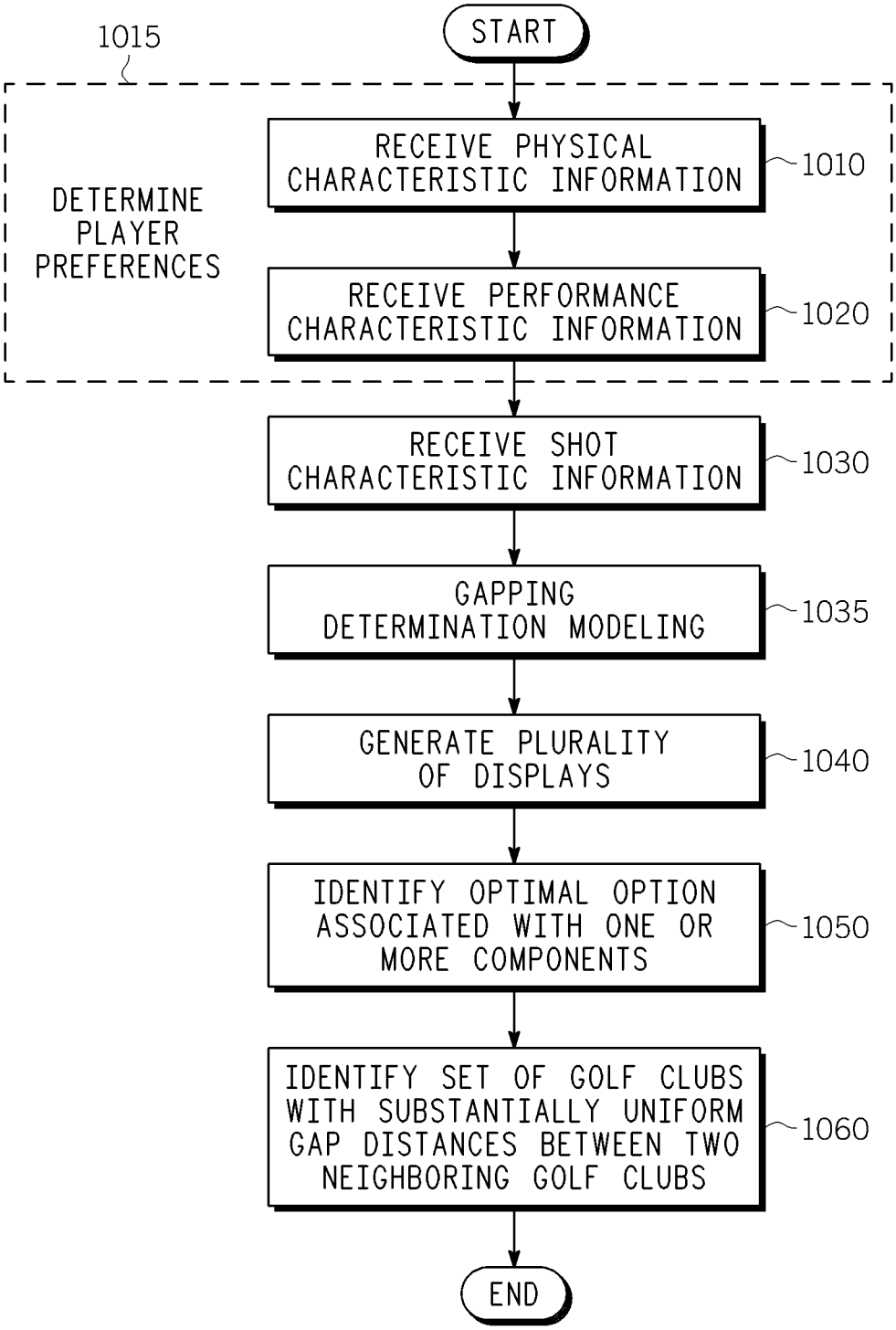
FIG. 10 depicts a flow diagram describing a process for gapping determination that may be performed by the exemplary custom golf club fitting system that can provide gapping determination.

FIG. 10 depicts a flow diagram describing a process 101 for gap distance determination that may be performed by the exemplary custom golf club fitting system (e.g., 100 of FIG. 1). First player preferences are determined 1015. Determining player preferences can include two sub steps 1010, 1020. Initially, at block 1010, individual preferences can be inputted. At block 1010, physical characteristic information (210 of FIG. 2) associated with the individual (e.g., via the input device 110 of FIG. 1) can be inputted or received. At block 1020, the gapping analyzer (270 of FIG. 2) can receive performance characteristic information (220 of FIG. 2) associated with the individual (140 of FIG. 1). Further, at block 1030, the gapping analyzer (270 of FIG. 2) can receive shot characteristic information (230 of FIG. 2) associated with the individual that can be taken via the tracking device (120 of FIG. 1).

At block 1035, the physical characteristic information (210 of FIG. 2), the performance characteristic information (220 of FIG. 2), and the shot characteristic information (230 of FIG. 2), can be processed or modeled by (e.g., via the trajectory analyzer) (240 of FIG. 2), the shot dispersion analyzer (250 of FIG. 2), the component option analyzer (260 of FIG. 2), and/or the graphical user interface (280 of FIG. 2). At block 1040, the results may be used to generate the plurality of displays (300 of FIG. 3).

At block 1050, a process implemented by the component option analyzer (260 to FIG. 2), may identify a suitable option associated with one or more components of a golf club. At block 1060, a set of golf clubs with specified gap distances between two neighboring golf clubs in the set can be identified.

Figure 11:
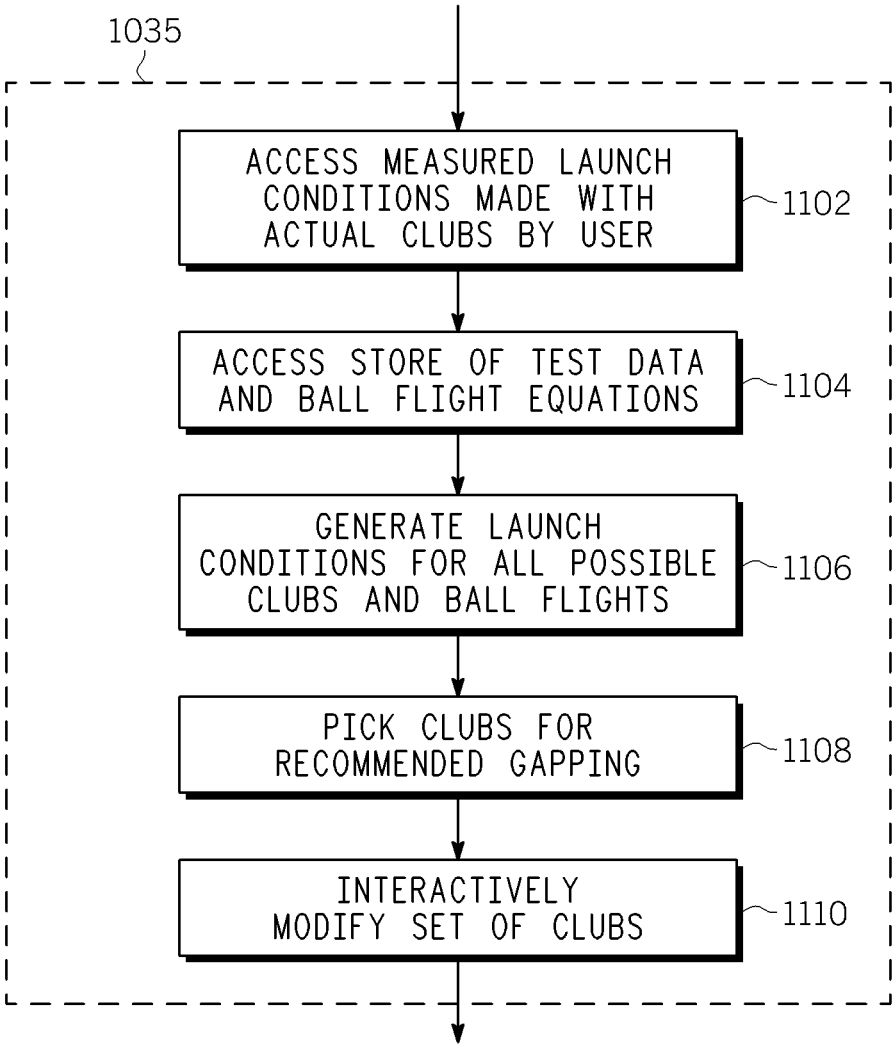
FIG. 11 a flow diagram describing further detail of the gapping determination block of the process for gapping determination.

FIG. 11 is a flow diagram describing further detail of the gap distance determination and modeling block (1035 of FIG. 10) of the process for gap distance determination (101 of FIG. 1). At block 1102, the data collected from an individual's (140 of FIG. 1) use of the fitting system with actual clubs may be loaded. Club data as well as ball flight information may be included in this data. Ball flight information may include data relating to vertical launch angle, spin rate, and the like. Typically, there can be gaps in the data collected, as the user has only hit a few clubs to generate data for the gapping analysis. As seen in the previous example of FIG. 7, four clubs have measured data (lob wedge, 6-iron, hybrid 15°, and driver). The process may then use the player's actual shot information for these clubs to determine a carry distance, total distance, and gap distance for these clubs. In the example of FIG. 7 the gap distance is based upon the carry distance, however the gap could also be based upon total distance.

At block 1104, stored test data and ball flight equations for modeling purposes can be accessed. To populate a full set of possible clubs, the database can be consulted to fill out an array of clubs that includes cataloged data (stored test data) and previously collected player data recorded from the user's test shots. In particular, information obtained from exemplary camera or radar measurements utilized by the ball flight equations may include ball speed, vertical launch angle, spin rate, spin axis, and the like. According to user preferences from the interview process, certain clubs may be excluded from the array. For the clubs allowed by the individual, all possible clubs may be made up virtually to populate the array. For any clubs that may be lacking stored data, data for the missing club may be extrapolated by conventional numerical techniques. As shown in FIG. 7 under the "type" column, there are a plurality of clubs designated as "calculated". These clubs are ones the user may wish to include in his set but has not hit a shot to determine the carry, total, or gap distance. Test data for these clubs will be loaded to determine carry, total and gap distances fore these clubs that the user has not hit.

At block 1106, launch conditions for all possible clubs and ball flights can be determined from initial ball launch conditions. Conventional equations known to those skilled in the art describing ball flight, may also be loaded for processing in this processing phase. These equations may take launch parameters of a golf ball to determine a full ball flight model including bounce and roll for each club. Thus, the test shot information providing a ball flight model may be combined with the library of club parameters ("library information") to estimate the flight pattern of the ball and the total distance traveled, typically utilizing known linear or quadratic equations. Equation of higher order may be used if desired. Distances traveled can include carry distances and total distances. Once the shot distance for each club may be calculated, the gaps can be determined as described previously. As shown in the exemplary FIG. 7, the model has utilized the club library information for the "calculated" clubs and the user supplied data for the "measured" clubs to fill in the carry, total and gap distances for all of the clubs. In actuality, there may be more results that were calculated than shown in FIG. 7, since the process will only pick for display clubs that yield a specified gap distance, which is determined in the next block.

At block 1108, clubs are picked for recommended gap distances. Once the shot distances are known, the clubs can be sorted to recommend gap distances based on user input and preferences previously described. The results may be provided in a table, bar graph, or other suitable user interface. A set of clubs may then be suggested. Alternatively, a plurality of sets of clubs may be suggested. As shown in exemplary FIG. 7, a number of clubs having specified gaps may be displayed.

At block 1110, the set of clubs can be modified interactively. Typically, using the user interface (150 of FIG. 1), clubs can be substituted if the individual (140 of FIG. 1) desires to make a change. Selection may be aided by the various graphical user interfaces (300 of FIG. 3), that may be provided for the clubs under consideration. As shown in exemplary FIG. 7, a user may wish to add or delete clubs based on the results found. As shown in FIG. 7, the user may wish to select either the 4-iron or the hybrid 22°, since the total distance is the same for each club (180 yards), but the carry distance upon which the gap was calculated differs (165 yards, and 175 yards respectively). The user may wish to eliminate a club since he can obtain the same total distance.

Alternatively, the gapping analyzer 270 may identify a progression in gap distances in a set of golf clubs (e.g., the gap distance between two neighboring golf clubs in the set may get wider or narrower through the set). In particular, the gapping analyzer 270 may identify a first gap distance for a first group of golf clubs in the set and a second gap distance for second group of golf clubs in the same set. In one example, the gapping analyzer 270 may identify the first gap distance of eight yards for the wedge-type golf clubs in a set, and a second gap distance of ten yards for the iron-type golf clubs. Further, the gapping analyzer 270 may identify a third gap distance of 15 yards for the fairway wood-type golf clubs.

Figure 12:
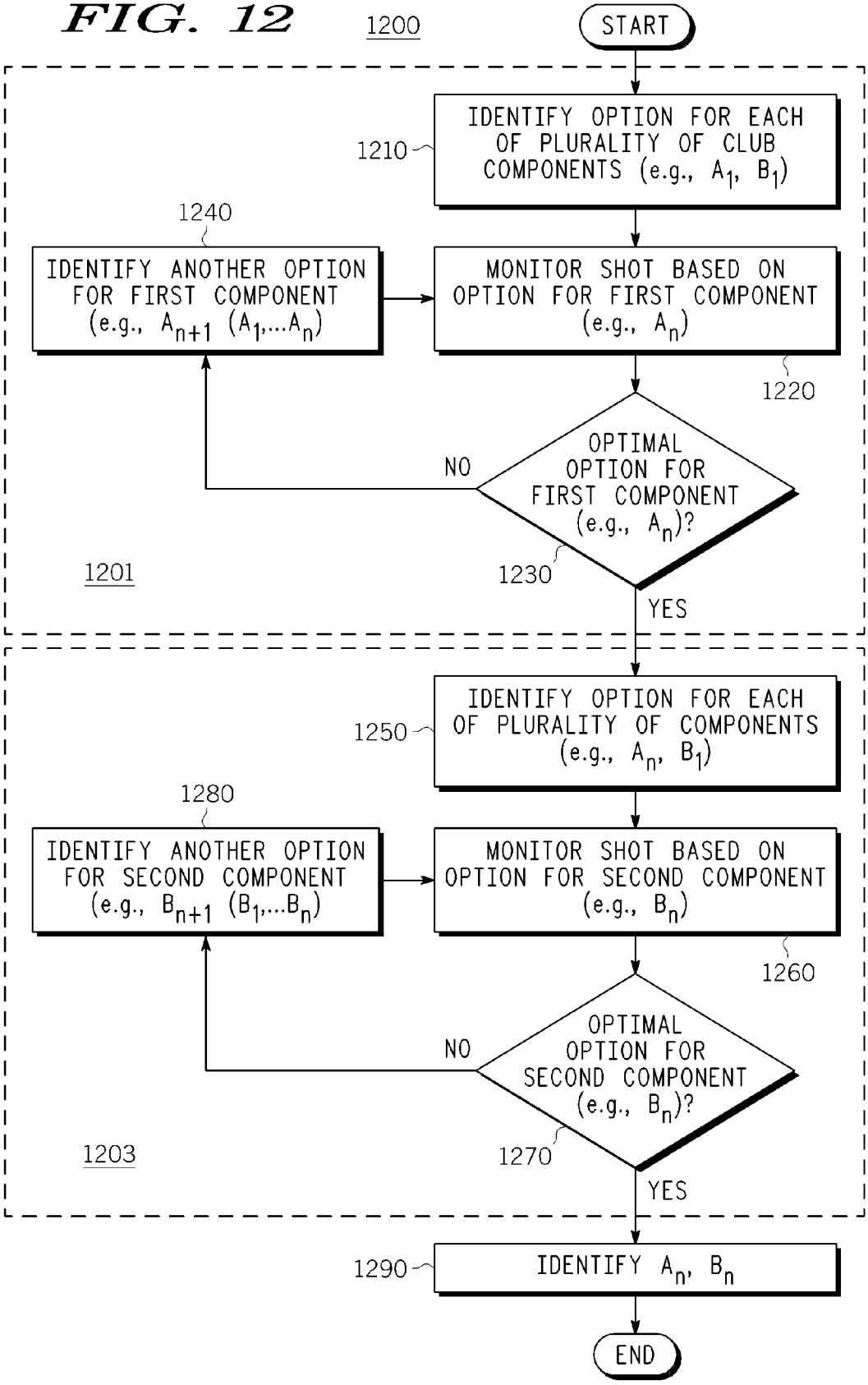
FIG. 12 is a flow diagram showing further detail of a first exemplary process for identifying a most suitable option associated with one or more golf clubs.

FIG. 12 is a flow diagram showing further detail of a first exemplary process 1200, for identifying a most suitable option associated with one or more golf clubs (1050 of FIG. 10). The processing device (130 of FIG. 1), may identify components of a golf club to the individual, based on the physical characteristic information (210 of FIG. 2), the performance characteristic information (220 of FIG. 2), and/or the shot characteristic information (230 of FIG. 2) associated with the individual.

Further, although a particular order of actions are illustrated, these actions can be performed in other temporal sequences. Again, the exemplary process 1200 is merely provided and described in conjunction with the processing device (130 of FIGS. 1 and 2), as an example of one way to recommend a golf club to the individual.

The process 1200 may begin by identifying an option for each of a plurality of components of a golf club (block 1210). In general, the process 1200 may isolate each of the plurality components in an effort to determine the best option for each of the plurality of components 1201, 1203.

That is, the individual (140 of FIG. 1) may take one or more shots at a golf ball with a golf club including the first option of the first component. In one example, the fitting system (100 of FIG. 1) may be fitting the individual for a driver-type golf club. Accordingly, the component option analyzer (230 of FIG. 2) may identify a particular model for the individual based on the physical characteristic information (210 of FIG. 2) and the performance characteristic information (220 of FIG. 2). At block 1220, the process 1200 may monitor, via the tracking device (120 of FIG. 1), a user taking one or more shots using a club having a first option of the first component (e.g., $A_1$) (block 1220).

At block 1230, based on the shot result from block 1220, the component option analyzer (230 of FIG. 2) may determine whether the first option (e.g., $A_1$) is a most suitable option for the first component. If the first option is not the most suitable option for the first component, the process routes to block 1240 to identify a second option of the first component (e.g., $A_2$). The process may continue to look as described above until the component option analyzer (260 of FIG. 2) identifies the most suitable option for the first component (e.g., $A_N$).

Returning to block 1230, the first option for the first component has been determined, the process may proceed. At block 1250, the process may next identify an option for the second component. This second component may be based on the most suitable option determined for the first component. For example, the process may determine an optimal loft associated with the optimal model collected or assembled so far. At block 1260, the process may monitor via the launch monitor (120 of FIG. 1) one or more shots based on a club incorporating the first option of the second component (e.g., $B_1$).

At block 1220, based on the measured shot results from block 1260, the component option analyzer (230 of FIG. 2), may determine whether the first option (e.g., $B_1$) is the most suitable option for the second component. If the first option is not the optimal option for the second component, the process may proceed to block 1280 to identify a second option of the second component (e.g., $B_2$). The process may continue as described above, until the component option analyzer identifies a suitable option for the second component (e.g., $B_N$). At block 1260, parts may be measured within variation introduced for its second component, with the results evaluated again at block 1220.

Returning to block 1270, once the first option is determined to be a suitable option for the second component, the process may proceed to block 1290 to identify the most suitable options for the first and second components (e.g., $A_N$, $B_N$).

Although the process may depict the identification of the most suitable options for two components, alternative examples of the process may be expanded to identify suitable options for more than two components (or alternatively for only one component). While particular order of actions are illustrated, these actions may be performed in other temporal sequences. For example, two or more actions depicted, may be performed sequentially, concurrently, or simultaneously. The methods, apparatus, and systems described herein are not limited in this regard.

As noted above, the process 1200 may initially identify a suitable option of an initial component. In response to identifying the suitable option of the initial component, the process may identify a suitable option of a subsequent component, based on the suitable option found for the initial component. In further alternative examples, the process may iterate one or more times to further tune the components selected.

Figure 13:
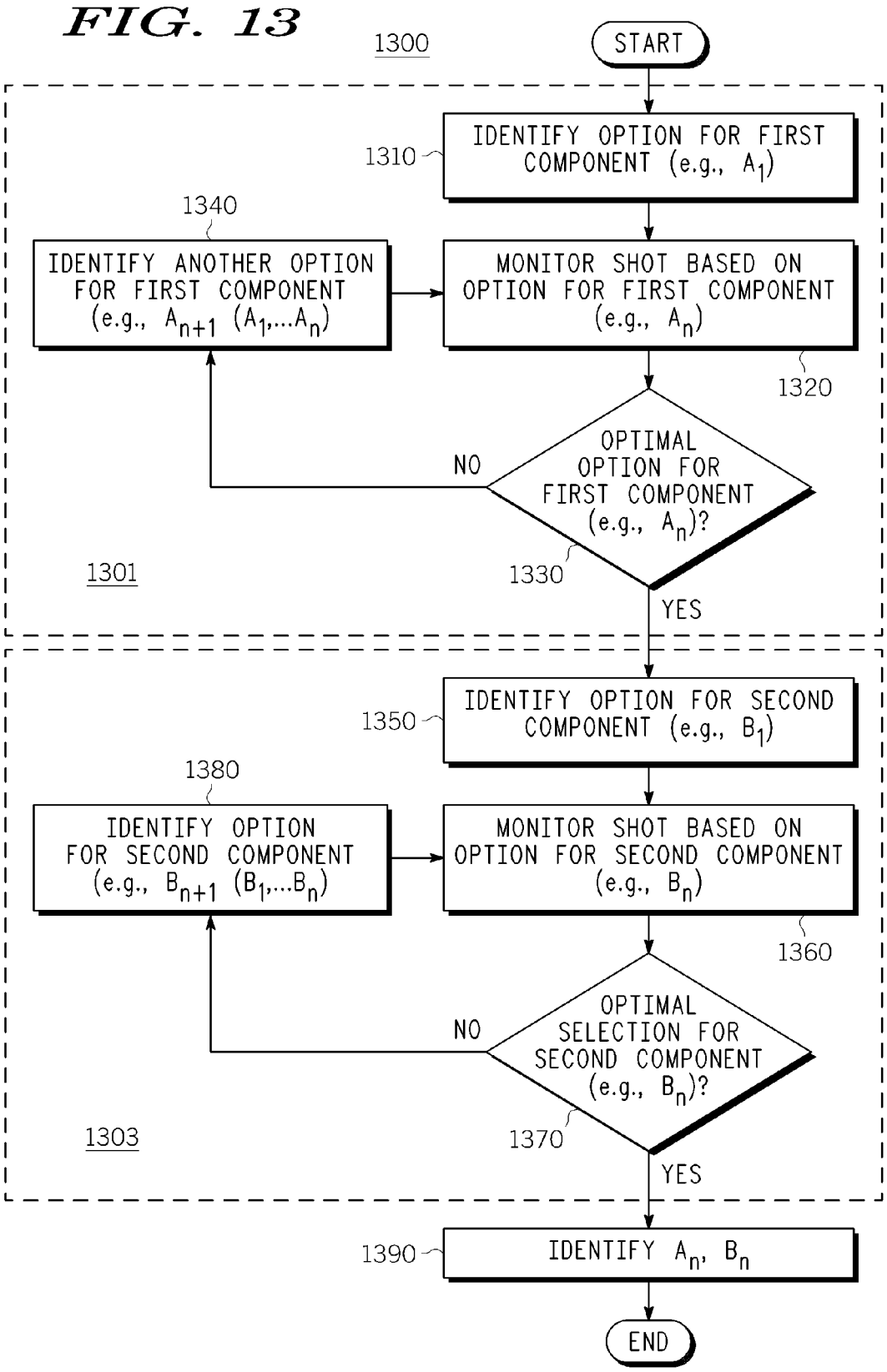
FIG. 13 is a flow diagram showing further detail of a second exemplary process for identifying a most suitable option associated with one or more golf clubs.

FIG. 13 is a flow diagram showing further detail of a second exemplary process 1300 for identifying a most suitable option associated with one or more golf clubs (1050 of FIG. 10). At block 1310, the process 1300 may begin with identifying an option for each of a plurality of components of a golf club 1301, 1303. Next, at block 1320, the process may monitor (e.g., via the launch monitor 130 of FIG. 1) one or more test shots based on utilizing a first option or settling for the first component (e.g., $A_1$).

Based on the shot result from block 1320, the component option analyzer (230 of FIG. 2) may at block 1330, determine whether the first option (e.g., $A_1$) is a suitable option for the first component. If the first option is not the most suitable option for the first component, the process may proceed to block 1340 to identify a second option of the first component (e.g., $A_2$). The process may continue to loop as described above, until the component option analyzer (260 of FIG. 2) identifies the most suitable option for the first component (e.g., $A_N$) by using the shot monitor data collected to evaluate the adjustment of the component.

Turning back to block 1330, if the first option is the most suitable option for the first component, the process may proceed to block 1350 to identify an option for the second component independent of the optimal option for the first component.

The process 1300 may monitor (e.g., via the launch monitor 130 of FIG. 1) one or more shots based on a first option of the second component (e.g., $B_1$) (block 1360).

Based on the test shot results from block 1360, the component option analyzer (230 of FIG. 2) may determine at block 1370, whether the first option (e.g., $B_1$) is a suitable option for the second component (block 1370). If the first option is not the optimal option for the second component, the process may proceed to block 1380 identify a second option of the second component (e.g., $B_2$). The process 1300 may continue looping as described above until the component option analyzer (260 of FIG. 2) identifies a suitable option for the second component (e.g., $B_N$).

Returning to block 1370, once a suitable option for the second component is found, the process may proceed to block 1390 to identify the optimal options for the first and second components (e.g., $A_N$, $B_N$).

The first example process may be implemented as machine-accessible instructions, utilizing any of many different programming codes stored on any combination of machine-accessible media such as, a volatile or nonvolatile memory or other mass storage device (e.g., a floppy disk, a CD, and a DVD). For example, the machine-accessible instructions may be embodied in a machine-accessible medium such as, a programmable gate array, an application specific integrated circuit (ASIC), an erasable programmable read only memory (EPROM), a read only memory (ROM), a random access memory (RAM), a magnetic media, an optical media, and/or any other suitable type of medium.

Although FIG. 13 may depict identifying suitable or acceptable options for two components, the methods, apparatus, and systems described herein may identify optimal options for more than two components (or alternating for a single component). While particular order of actions are illustrated in FIG. 13, these actions may be performed in other temporal sequences. For example, two or more actions depicted in FIG. 13 may be performed sequentially, concurrently, or simultaneously. The methods, apparatus, and systems described herein are not limited in this regard.

Figure 14:
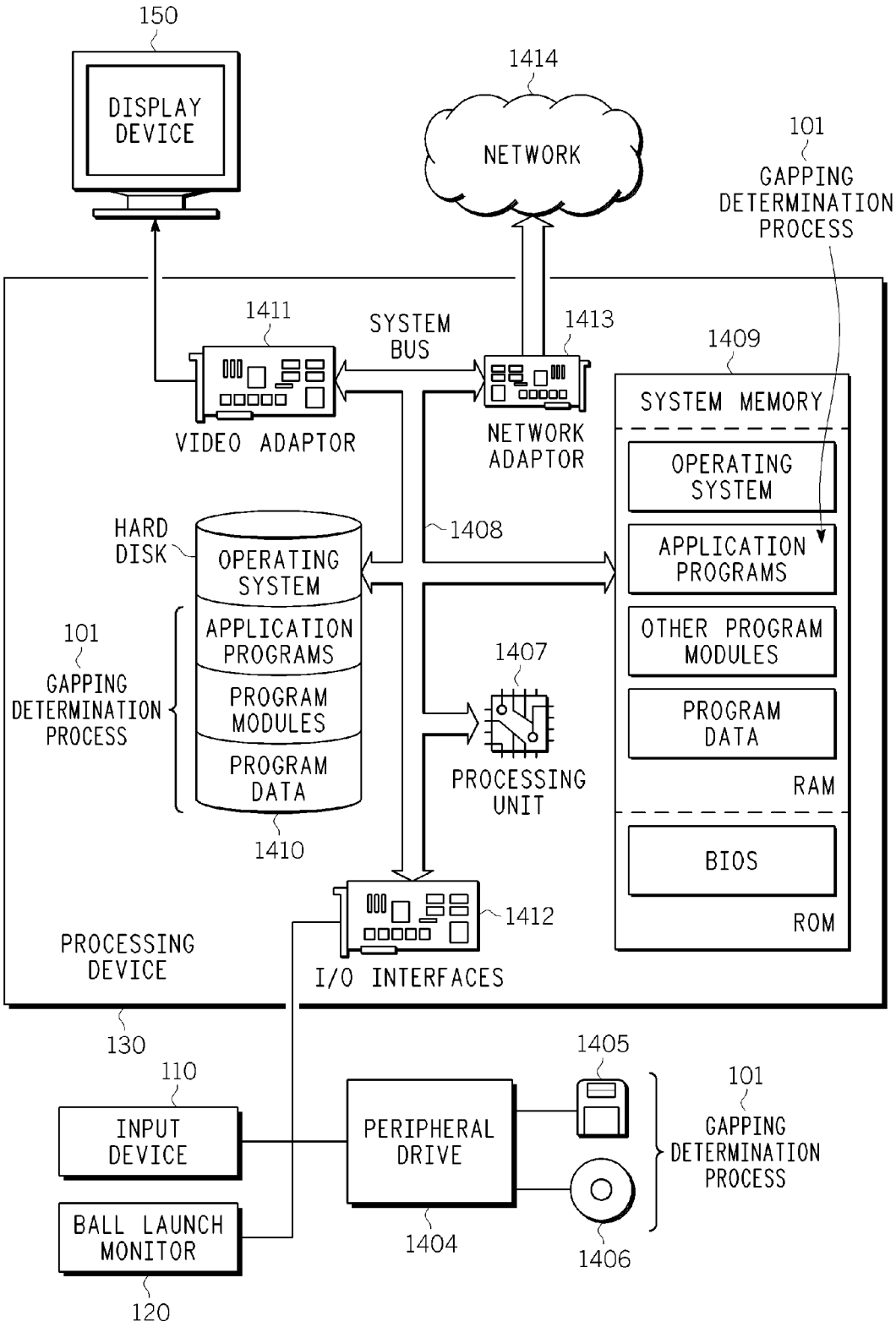
FIG. 14 is a block diagram of an exemplary component system suitable for implementing gapping determination.

FIG. 14 illustrates an exemplary fitting system computing environment 100 in which the gapping determination process 101 described in this application, may be implemented. Exemplary fitting system computing environment 100 is only one example of a suitable computing system and is not intended to limit the examples described in this application to this particular computing environment.

For example, the computing environment 100 can be implemented with numerous other general purpose or special purpose computing system configurations. Examples of well known computing systems may include, but are not limited to, personal computers, hand-held or laptop devices, microprocessor-based systems, multiprocessor systems, and the like.

The computer 100 includes a general-purpose computing system in the form of a computing device 130. The components of computing device 130 can include one or more processors (including CPUs, GPUs, microprocessors and the like) 1407, a system memory 1409, and a system bus 1408 that couples the various system components. Processor 1407 processes various computer executable instructions, including those to implement a gapping determination process 101 to control the operation of computing device 130 and to communicate with other electronic and computing devices (not shown). The system bus 1408 represents any number of several types of bus structures, including a memory bus or memory controller, a peripheral bus, an accelerated graphics port, and a processor or local bus using any of a variety of bus architectures.

The system memory 1409 includes computer-readable media in the form of volatile memory, such as random access memory (RAM), and/or non-volatile memory, such as read only memory (ROM). During operation, an application program implementing a process for gapping determination 101 may be loaded in volatile memory. A basic input/output system (BIOS) is stored in ROM. RAM typically contains data and/or program modules that are immediately accessible to and/or presently operated on by one or more of the processors 1407.

Mass storage devices 1404, may be coupled to the computing device 130 or incorporated into the computing device by coupling to the buss. Such mass storage devices 1404 may include a magnetic disk drive which reads from and writes to a removable, non volatile magnetic disk (e.g., a "floppy disk") 1405, or an optical disk drive that reads from and/or writes to a removable, non-volatile optical disk such as a CD ROM or the like 1406. Computer readable media 1405, 1406 typically embody computer readable instructions, data structures, program modules and the like supplied on floppy disks, CDs, portable memory sticks and the like. An application program implementing a process for gapping determination 101 may be disposed upon the above mentioned mass storage devices. Also, stored test data utilized by the gapping analysis may be stored on the computer readable media for use by the process for gapping determination 101.

Any number of program modules such as, a process for gapping determination can be stored on the hard disk 1410, mass storage device 1404, ROM and/or RAM 14-9, including by way of example, an operating system, one or more application programs (such as one for determining gapping 101), other program modules, and program data. Each of such operating system, application programs, other program modules and program data (or some combination thereof) may include an embodiment of the methods 101 described herein.

A display device 150 can be connected to the system bus 1408 via an interface, such as a video adapter 1411. Such a display device may be suitable for displaying a graphical user interface (300 of FIG. 3) for the gapping determination process 101. A user can interface with computing device 702 via any number of different input devices 110 such as a keyboard, pointing device, joystick, game pad, serial port, and/or the like. These and other input devices are connected to the processors 1407 via input/output interfaces 1412 that are coupled to the system bus 1408, but may be connected by other interface and bus structures, such as a parallel port, game port, and/or a universal serial bus (USB).

Computing device 100 can operate in a networked environment using connections to one or more remote computers through one or more local area networks (LANs), wide area networks (WANs), and the like. The processing device 130 can be connected to a network 1414 via a network adapter 1413 or alternatively by a modem, DSL, ISDN interface or the like. A computer program product may include instructions, control logic, program information and the like transferred over the network, typically by storage or transfer to volatile and non volatile memory, as well as conventional storage media such as floppy disks, CDs, and the like.

Those skilled in the art will realize that the process sequences described above may be equivalently performed in any order to achieve a desired result. Also, sub-processes may typically be omitted as desired without taking away from the overall functionality of the processes described above.

While particular order of actions are illustrated in the figure, these actions may be performed in other temporal sequences. For example, two or more actions depicted in the figure may be performed sequentially, concurrently, or simultaneously. The methods, apparatus, and systems described herein are not limited in this regard.

Although certain example methods, apparatus, and/or articles of manufacture have been described herein, the scope of coverage of this disclosure is not limited thereto. On the contrary, this disclosure covers all methods, apparatus, and/or articles of manufacture fairly falling within the scope of the appended claims either literally or under the doctrine of equivalents.

What is claimed is:

1. A method comprising:

determining golf preferences of an individual, including one or more target gap distances;

receiving golf ball shot characteristic information of one or more golf shots of a club subset by the individual using a tracking device;

determining, with a gapping analyzer, a proposed golf club set exhibiting the one or more target gap distances between adjacent clubs of the proposed golf club set;

wherein:

the golf ball shot characteristic information comprises:

first golf ball shot characteristic information comprising golf ball launch condition data from one or more golf shots with a first subset club of the club subset; and second golf ball shot characteristic information comprising golf ball launch condition data from one or more golf shots with a second subset club of the club subset;

the club subset comprises fewer golf clubs than the proposed golf club set; and determining the proposed golf club set comprises:

providing the gapping analyzer with:

the golf preferences; and the golf ball shot characteristic information;

accessing a database with the gapping analyzer, the database comprising a library of golf club parameters for a library of golf clubs; and calculating with the gapping analyzer, based on the golf preferences, the first golf ball shot characteristic information, and the second golf ball shot characteristic information, a club set solution regarding which of the golf clubs of the library of golf clubs to select for the proposed golf club set to exhibit the one or more target gap distances; and generating at least one display configured to present the one or more target gap distances as exhibited by at least a portion of the proposed golf club set, the display comprising at least one of a component option display or a gapping analysis display, wherein a trajectory analyzer is coupled to the gapping analyzer and utilizes the tracking device to analyze initial golf ball shot characteristic information from golf ball launch data of one or more fitting shots by the individual to determine final shot characteristic information of the one or more fitting shots for a shot trajectory display.

2. The method of claim 1, wherein:
determining the proposed golf club set comprises:
identifying an option for a component of a golf club of the proposed golf club set to achieve at least one of the one or more target gap distances; and
the option for the component comprises at least one of: a model option, a loft option, a shaft option, a length option, or a grip option.

3. The method of claim 1, wherein:
determining the proposed golf club set comprises:
identifying the proposed golf club set with the gapping analyzer to comprise substantially uniform gap distances between neighboring golf clubs, the one or more target gap distances comprising the substantially uniform gap distances.

4. The method of claim 1, wherein:
determining the proposed golf club set comprises:
identifying the proposed golf club set with the gapping analyzer to comprise a progression of gap distances, the one or more target gap distances comprising the progression of gap distances;
wherein the progression of gap distances includes at least a first gap distance and a second gap distance; and
wherein the first and second gap distances are different from each other.

5. The method of claim 1, wherein the one or more target gap distances are defined by differences in carry distances between adjacent clubs in the proposed golf club set.

6. The method of claim 1, in which the one or more target gap distances are defined by differences in total distances between adjacent clubs in the proposed golf club set.

7. The method of claim 1, in which the golf ball launch condition data is used to determine a golf ball flight pattern and a golf ball total distance traveled.

8. The method of claim 1, in which the golf ball shot characteristic information includes golf ball flight information.

9. The method of claim 1, wherein:
the first subset club of the club subset comprises a low-lofted subset club of a first golf club type;
the second subset club of the club subset comprises a high-lofted subset club of a second golf club type;
the first golf club type comprises one of:
an iron/wedge-type, a hybrid-type, a fairway-wood-type, or a driver type; and
the second golf club type comprises a different one of: the iron/wedge-type, the hybrid-type, the fairway-wood-type, or the driver type.

10. The method of claim 9, wherein:
the club subset further comprises:
a third subset club comprising a mid-lofted subset club.

11. The method of claim 9, wherein:
the gapping analyzer is configured to propose, as part of the proposed golf club set, a proposed golf club of a third golf club type even when the one or more golf shots of the club subset by the individual for the golf ball shot characteristic information comprises no golf shot with a subset club of the third golf club type.

12. The method of claim 1, wherein:
the gapping analyzer is configured to identify for the proposed golf club set:
first and second proposed golf clubs of first and second golf club types and comprising a first-second gap distance between themselves;
the first-second gap distance corresponding to at least one of the one or more target gap distances;
the first golf club type comprises one of:
an iron/wedge-type, a hybrid-type, a fairway-wood-type, or a driver type; and
the second golf club type comprises a different one of: the iron/wedge-type, the hybrid-type, the fairway-wood-type, or the driver type.

13. The method of claim 12, wherein:
the gapping analyzer is configured to propose, in the club set solution for the proposed golf club set, a club type transition between a first type of golf club to a second type of golf club to achieve one of the one or more target gap distances, the club type transition comprising at least one of:
an iron-to-hybrid transition; or
a hybrid-to-fairway-wood transition.

14. The method of claim 1, wherein:
the club subset comprises at least three clubs.

15. The method of claim 1, wherein:
the one or more target gap distances are received by the gapping analyzer from the individual prior to, and as an input for, calculating the club set solution for the proposed golf club set.

16. The method of claim 1, further comprising:
wherein the shot trajectory display is three dimensional; and
wherein the trajectory analyzer generates a plurality of traces associated with golf ball flights for the one or more fitting shots, the plurality of traces indicating at least a height and an angle of a golf ball shot.

17. The method of claim 16, wherein the traces represent an average number of golf shots.

18. The method of claim 1, wherein the shot trajectory display comprises a first display of gapping determination based upon initial contact on landing and a second display of gapping determination based upon final contact or roll to determine gaps between clubs.

19. The method of claim 1, wherein the golf ball shot characteristic information comprises an angle of a golf ball's trajectory in response to impact with a golf club, a horizontal launch angle, carry distance, and total distance.

20. The method of claim 1, further comprising
utilizing a shot dispersion analyzer to determine deviation of golf shots from a predetermined center line; and
generating a shot dispersion display to indicate one or more slice shots or fade shots of the golf shots.

21. The method of claim 1, wherein the tracking device comprises at least one of a ball launch monitor, ball flight monitor, photographic device, or radar tracking device, for tracking a plurality of data points associated with a flight of a golf ball.

22. A system comprising:
a processing device comprising a gapping analyzer; and
a tracking device coupled to the processing device;
wherein:
the gapping analyzer is configured to:
receive golf preferences of an individual, the golf preferences comprising information regarding one or more target gap distances between adjacent clubs for a proposed golf club set;
receive, from the tracking device, golf ball shot characteristic information of one or more golf shots of a club subset by the individual;
access a database comprising a library of library golf club parameters for library golf clubs; and
calculate a club set solution regarding which of the library golf clubs to select for the proposed golf club set to exhibit the one or more target gap distances;

the golf ball shot characteristic information comprises:
first golf ball shot characteristic information comprising golf ball launch condition data from one or more golf shots with a first subset club of the club subset; and
second golf ball shot characteristic information comprising golf ball launch condition data from one or more golf shots with a second subset club of the club subset;
the club subset comprises fewer golf clubs than the proposed golf club set; and
the club set solution is calculated by the gapping analyzer based on the golf preferences, the first golf ball shot characteristic information, and the second golf ball shot characteristic information,
wherein the processing device comprises
a trajectory analyzer coupled to the gapping analyzer that utilizes the tracking device to analyze initial shot characteristic information from golf ball launch data of one or more fitting shots by the individual to determine final shot characteristic information of the one or more fitting shots for a shot trajectory display.

23. The system of claim 22, further comprising:
a display device configured to present at least one of:
a component option display; or
gapping analysis display.

24. The system of claim 22, in which the gapping analyzer is configured to receive physical characteristic information and performance characteristic information about the individual.

25. The system of claim 22, in which the tracking device couples the golf ball shot characteristic information to the processing device.

26. The system of claim 22, wherein:
the first subset club of the club subset comprises a low-lofted subset club of a first golf club type;
the second subset club of the club subset comprises a high-lofted subset club of a second golf club type;
the first golf club type comprises one of:
an iron/wedge-type, a hybrid-type, a fairway-wood-type, or a driver type; and
the second golf club type comprises a different one of:
the iron/wedge-type, the hybrid-type, the fairway-wood-type, or the driver type.

27. The system of claim 26, in which:
the gapping analyzer is configured to propose, as part of the proposed golf club set, a proposed golf club of a third golf club type even when the one or more golf shots of the club subset by the individual for the golf ball shot characteristic information comprises no golf shot with a subset club of the third golf club type.

28. The system of claim 22, wherein:
the proposed golf club set comprises:
a first proposed golf club of a first type; and
a second proposed golf club of a second type different than the first type;
the first and second proposed golf clubs comprising a first-second gap distance between themselves;
the gapping analyzer is configured to identify the first and second proposed golf clubs, based on the first-second gap distance, to achieve at least one of the one or more target gap distances;
the first type of the first proposed golf club comprises one of:
an iron/wedge-type, a hybrid-type, a fairway-wood-type, or a driver type; and
the second type of the second proposed golf club comprises a different one of:
the iron/wedge-type, the hybrid-type, the fairway-wood-type, or the driver type.

29. The system of claim 22, wherein:
the processing device comprises:
a shot dispersion analyzer coupled to the gapping analyzer and configured to analyze shot characteristic information of one or more fitting shots by the individual to generate shot dispersion information for a shot dispersion display.

30. The system of claim 22, wherein:
the processing device comprises:
a component option analyzer coupled to the gapping analyzer and configured to:
analyze one or more of:
physical characteristic information of an individual;
performance characteristic information of the individual; or
the shot characteristic information of the set of one or more fitting shots by the individual; and
identify one or more golf club component options for one or more proposed clubs of the proposed golf club set.

31. The system of claim 22, in which:
the one or more target gap distances are received by the gapping analyzer prior to, and as an input for, calculating the club set solution for the proposed golf club set.

32. The system of claim 22, in which:
the gapping analyzer is configured to propose, in the club set solution for the proposed golf club set, a club type transition between a first type of golf club to a second type of golf club to achieve one of the one or more target gap distances, the club type transition comprising at least one of:
an iron-to-hybrid transition; or
a hybrid-to-fairway-wood transition.

33. A method for displaying information, comprising:
calculating, with a computerized gapping processor, a club set solution with respect to one or more target gap distances between neighbor golf clubs of a plurality of golf clubs for a proposed golf club set;
displaying a component option display showing the one or more target gap distances between the neighbor golf clubs of the plurality of golf clubs; and
displaying a gapping determination display showing a gapping between two or more of the neighbor golf clubs of the plurality of golf clubs;
wherein:
the component option display and the gapping determination display are calculated by the computerized gapping processor based on shot characteristic information of one or more golf shots of a club subset by the individual;
the shot characteristic information comprises:
first golf ball shot characteristic information comprising golf ball launch condition data from one or more golf shots with a first subset club of the club subset; and
second golf ball shot characteristic information comprising golf ball launch condition data from one or more golf shots with a second subset club of the club subset;
the club subset comprises fewer golf clubs than the proposed golf club set;

the club set solution is calculated by the computerized gapping processor based on the one or more target gap distances, the first golf ball shot characteristic information, and the second ball shot characteristic information of the individual;

for each of the plurality of golf clubs, the component option display presents a club type, a club model, and at least one of a shot carry distance or a shot total distance calculated for the individual; and the gapping determination display presents shot trajectories calculated by the computerized gapping processor for the two or more of the neighbor golf clubs and a graphical representation of the gapping therebetween.

34. The method for displaying information of claim 33, in which the gapping is based on ball flight distance.

35. The method for displaying information of claim 33, in which the gapping is based on ball flight distance and ball roll distance.

36. The method for displaying information of claim 33, further comprising:

displaying a dispersion display illustrating two or more dispersion perimeters for a plurality of golf shots by the individual relative to a target centerline and based on the shot characteristic information.

37. The method for displaying information of claim 36, wherein:

a first dispersion perimeter of the two or more dispersion perimeters is correlated to a first set of golf shots of the plurality of golf shots made with a first golf club of the plurality of golf clubs; and a second dispersion perimeter of the one or more dispersion perimeters is correlated to a second set of golf shots of the plurality of golf shots made with a second golf club of the plurality of golf clubs.

38. The method for displaying information of claim 33, wherein:

the computerized gapping processor is configurable as a gapping analyzer to process one or more of physical characteristic information of the individual, performance characteristic information of the individual, or the shot characteristic information of the individual to identify the plurality of golf clubs out of a database of library golf clubs and library golf club parameters to achieve one or more target gap distances between the plurality of golf clubs; and the computerized gapping processor is configurable as a component option analyzer to process one or more of the physical characteristic information of the individual, the performance characteristic information of the individual, or the shot characteristic information of the individual to:

identify one or more options for one or more golf club components of the proposed golf club set to achieve at least one of the one or more target gap distances.

39. The method for displaying information of claim 33, in which the one or more target gap distances are received by the computerized gapping processor prior to, and as an input for, calculating the club set solution for the proposed golf club set.

40. The method for displaying information of claim 33, in which:

the computerized gapping processor is configured to propose, in the club set solution for the proposed golf club set, a club type transition between a first type of golf club to a second type of golf club to achieve one of the one or more target gap distances, the club type transition comprising at least one of:

an iron-to-hybrid transition; or a hybrid-to-fairway-wood transition.

41. A computer program product having a gapping analyzer processor and instructions for causing the gapping analyzer processor to calculate a club set solution, the computer program product configured for: determining golf preferences associated with an individual, the golf preferences comprising one or more target gap distances;

receiving golf ball shot characteristic information of one or more golf shots of a club subset by the individual using a tracking device;

utilizing a trajectory analyzer coupled to the gapping analyzer and the tracking device to analyze initial shot characteristic information from golf ball launch data of one or more fitting shots by the individual to determine final shot characteristic information of the one or more fitting shots for a shot trajectory display determining the club set solution for a proposed golf club set with the gapping analyzer processor, the proposed golf club set exhibiting the one or more target gap distances between neighboring golf clubs of the proposed golf club set, the proposed golf club set determined by the gapping analyzer processor based on:

the one or more target gap distances; and the golf ball shot characteristic information; and generating a display to communicate the club set solution; wherein:

the golf ball shot characteristic information comprises:

first golf ball shot characteristic information comprising golf ball launch condition data from one or more golf shots with a first subset club of the club subset; and second golf ball shot characteristic information comprising golf ball launch condition data from one or more golf shots with a second subset club of the club subset;

the club subset comprises fewer golf clubs than the proposed golf club set; and determining the proposed golf club set with the gapping analyzer processor comprises:

accessing a database with the gapping analyzer processor, the database comprising a library of golf club parameters for a library of golf clubs; and identifying with the gapping analyzer processor the proposed golf club set from the library of golf clubs to exhibit the one or more target gap distances.

42. The computer program product of claim 41, further configured for:

identifying the proposed golf club set such that the one or more target gap distances comprise substantially uniform gap distances relative to each other.

43. The computer program product of claim 41, further configured for:

identifying the proposed golf club set such that the one or more target gap distances comprise a progression of gap distances, wherein the progression of gap distances includes at least a first gap distance and a second gap distance, and wherein the first and second gap distances are different from each other.

44. The computer program product of claim 41, in which determining the golf preferences further comprises:

receiving physical characteristic information of the individual; and receiving performance characteristic information of the individual.

45. The computer program product of claim 41, in which the golf ball shot characteristic information comprises initial ball launch information including vertical launch angle and spin rate.

46. The computer program product of claim 41, wherein: the gapping analyzer processor is configured to identify for the proposed golf club set:

first and second proposed golf clubs of first and second golf club types and comprising a first-second gap distance between themselves;

the first-second gap distance corresponding to at least one of the one or more target gap distances;

the first golf club type comprises one of:

an iron/wedge-type, a hybrid-type, a fairway-wood-type, or a driver type; and the second golf club type comprises a different one of:

the iron/wedge-type, the hybrid-type, the fairway-wood-type, or the driver type.

47. The computer program product of claim 41, wherein: the one or more target gap distances are received by the gapping analyzer processor prior to, and as an input for, calculating the club set solution for the proposed golf club set.

48. The computer program product of claim 41, wherein: the gapping analyzer processor is configured to propose, in the club set solution for the proposed golf club set, a club type transition between a first type of golf club to a second type of golf club to achieve one of the one or more target gap distances, the club type transition comprising at least one of:

an iron-to-hybrid transition; or a hybrid-to-fairway-wood transition.

* * * * *